US011284649B2

(12) United States Patent
Mou et al.

(10) Patent No.: US 11,284,649 B2
(45) Date of Patent: Mar. 29, 2022

(54) INTELLIGENT BRA

(71) Applicant: Microjet Technology Co., Ltd., Hsinchu (TW)

(72) Inventors: Hao-Jan Mou, Hsinchu (TW); Ta-Wei Hsueh, Hsinchu (TW); Yung-Lung Han, Hsinchu (TW); Chi-Feng Huang, Hsinchu (TW); Wei-Ming Lee, Hsinchu (TW); Chun-Yi Kuo, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 196 days.

(21) Appl. No.: 16/718,827

(22) Filed: Dec. 18, 2019

(65) Prior Publication Data

US 2020/0196683 A1 Jun. 25, 2020

(30) Foreign Application Priority Data

Dec. 21, 2018 (TW) ..... 107146564

(51) Int. Cl.

| | |
|---|---|
| ***A41C 3/10*** | (2006.01) |
| ***A41C 3/14*** | (2006.01) |
| *A41C 3/00* | (2006.01) |
| *F04B 45/047* | (2006.01) |

(52) U.S. Cl.

CPC ..... *A41C 3/105* (2013.01); *A41C 3/14* (2013.01); *A41B 2400/38* (2013.01); *A41C 3/0028* (2013.01); *F04B 45/047* (2013.01)

(58) Field of Classification Search

CPC ..... A41C 3/105; A41C 3/14; A41C 3/0028; A41B 2400/38

USPC ..... 450/38

See application file for complete search history.

(56) References Cited

U.S. PATENT DOCUMENTS

| | | | | |
|---|---|---|---|---|
| 5,347,656 | A * | 9/1994 | Fabritz | A41C 3/105 2/67 |
| 6,080,037 | A * | 6/2000 | Lee | A41C 3/105 450/38 |
| 6,302,760 | B1 * | 10/2001 | Dai | A41C 3/105 450/38 |

(Continued)

FOREIGN PATENT DOCUMENTS

| | | |
|---|---|---|
| CN | 105495712 B | 8/2017 |
| TW | M242216 U | 9/2004 |

(Continued)

*Primary Examiner* — Gloria M Hale

(74) *Attorney, Agent, or Firm* — Birch, Stewart, Kolasch & Birch, LLP

(57) ABSTRACT

An intelligent bra includes a main body and a gas-collecting actuating device. The main body comprising a supporting base, a cup set and two fixing elements. The cup set includes an outer layer, an inner layer and an air bag layer. The air bag layer includes an airflow channel, wherein a connection end of the airflow channel protrudes out from the cup set. The gas-collecting actuating device connects to the connection end and comprises a gas conveyor, a control module and a pressure sensor. The gas conveyor transports gas to the air bag layer to adjust the inner pressure. The control module controls the operation of the gas conveyor and a threshold setting mode of the pressure sensor. The pressure sensor detects the inner pressure of the air bag layer, so as to monitor and notify the control module to control the operation of the gas conveyor.

18 Claims, 18 Drawing Sheets

(56) References Cited

U.S. PATENT DOCUMENTS

| | | | | |
|---|---|---|---|---|
| 6,461,221 | B1 * | 10/2002 | Stilwell | A41C 3/0007 450/38 |
| 6,921,316 | B1 * | 7/2005 | Jian | A41C 3/105 450/38 |
| 8,801,495 | B1 * | 8/2014 | Guindon | A41C 3/105 450/36 |
| 2010/0068973 | A1 * | 3/2010 | Tseng | A41C 3/105 450/55 |
| 2011/0065358 | A1 * | 3/2011 | Fleeton | A41C 3/105 450/38 |
| 2013/0012100 | A1 * | 1/2013 | Chen | A41C 3/105 450/38 |
| 2014/0023602 | A1 * | 1/2014 | Tanaka | A61K 8/498 424/59 |
| 2015/0024657 | A1 * | 1/2015 | Chen | A41C 3/144 450/38 |
| 2015/0351465 | A1 * | 12/2015 | Duraku | A41C 3/105 450/38 |
| 2017/0231291 | A1 * | 8/2017 | Lima | A41C 3/0028 450/38 |

FOREIGN PATENT DOCUMENTS

| | | | |
|---|---|---|---|
| TW | M548452 | U | 9/2017 |
| TW | I617806 | B | 3/2018 |
| TW | 201821792 | A | 6/2018 |

* cited by examiner

INTELLIGENT BRA

FIELD OF THE INVENTION

The present disclosure relates to a bra, and more particularly to an inflatable intelligent bra for breast cancer detection.

BACKGROUND OF THE INVENTION

Bras are indispensable products for modern women, in which the stability of supporting the breasts is a key point of women's consideration when purchasing the bras. If the stability is poor, the bra may slip and dislocate easily with the wearer's body movement and it will make the wearer feel insecure and uncomfortable. The wearer also needs to readjust the position of the bra frequently, which causes inconvenience to the wearer.

On the other hand, most modern women wear bras for a long period of time in daily lives, which makes the comfort of bras also important to the consideration of the female consumers. Another advantage of wearing a bra is that the bra can push the breasts up and together to make the better shape of the breasts, and help preventing the breasts from expanding and sagging. So modern women also pay considerable attention to the push-up-and-together effect of the bras.

A conventional bra commonly utilizes the underwire to support the breasts, in which the underwire is made of hard steel and fastened to the lower edges of the cups. The metal underwire provides sufficient strength and supporting force to stably support the breasts and achieve the push-up-and-together effect for the breasts. However, the steel underwire is easy to be deformed. Moreover, it is rigid and has little elasticity. As a result, since the underwire is touching a woman's chest and close to her breasts every day, it would cause the woman an uncomfortable and oppression feeling.

In view of this, there are various bras designed to have no metal underwire in the current market. However, since there is no underwire to lift and push up the breasts, these types of bras have poor efficacy of pushing the breasts up and together. In other words, the non-underwire bras fail to maintain the shape of the breasts and are not optimal products to the female consumers.

Nowadays, the proportion of women suffering from breast cancer is increasing year by year. Accordingly, a touch sensor has been developed to detect the variations of the surface of breast. The touch sensor can also deliver the detected data to a detection receiving device (such as a smart phone or an application program of computers). The detected data is analyzed and delivers to an intelligent medical detection apparatus, so as to track the variation of breast and to generate a notification. If tumor cells are clustered in the breast, which may result in blood aggregation, so that the temperature is raised and the texture is changed. Consequently, the touch sensor can detect the variation of the surface of breast, and track the texture, the color and the temperature of the breast. If there is any abnormality observed, it can be treated as soon as possible, so that the risk of suffering breast cancer is decreased. However, the detection requirement is that the touch sensor had to be closely attached on the breast. Because of the curvature of the breast, it's less easy to and less likely to attach the touch sensor on the breast with a perfect match with respect to the curvature. If we adopt the conventional way that separately and directly puts the touch sensor on the breast, it may affect the detection accuracy of the touch sensor.

Therefore, there is a need of providing an intelligent bra having no metal underwire but providing great support to the breasts and having ability to push the breasts up and together as well as the underwire bra does, and also being effective and precise in breast cancer detection, so as to solve the drawbacks in prior arts.

SUMMARY OF THE INVENTION

An object of the present disclosure provides an intelligent bra to solve the problem that the bra has insufficient support to the breasts and the fitting problem during the breast cancer detection. The present disclosure provides an intelligent bra including a gas-collecting actuating device collaborating with the air bag layer of the cup set. The gas conveyor of the gas-collecting actuating device is controlled to inflate or deflate the air bag layer of the cup set. By monitoring and adjusting the appropriate inflation amount of the air bag layer through the threshold setting mode of the pressure sensor of the gas-collecting actuating device, the inner pressure thereof is adjusted. The hardness, the appearance and the support strength of the first cup and the second cup can be arbitrarily adjustable according to the breasts shape of each user to achieve the effects of supporting stably and pushing up. Meanwhile, the touch sensor is attached on the inner layer of the cup set, due to the inflation of the air bag layer, the touch sensor is pushed to closely fit the surface of the breasts, so that the touch sensor can detect the variation of the surface of the breast, and the detection accuracy of the touch sensor is enhanced. Consequently, the intelligent bra of the present disclosure is adjustable to fit the breasts of each user.

In accordance with an aspect of the present disclosure, there is provided an intelligent bra, which includes a main body and a gas-collecting actuating device. The main body comprising a supporting base, a cup set and two fixing elements. The supporting base is configured to carry the cup set and connected to the two fixing elements. The two fixing elements are respectively connected to two opposite sides of the supporting base so as to engage and connect with each other. The cup set includes an outer layer, an inner layer and an air bag layer. The air bag layer is disposed between the outer layer and the inner layer to be covered by both the outer layer and the inner layer. The air bag layer includes an airflow channel, wherein a connection end of the airflow channel can protrudes out from the cup set. The gas-collecting actuating device connects to the connection end of the airflow channel. The gas-collecting actuating device comprises a gas conveyor, a control module and a pressure sensor. The gas conveyor transports gas to the air bag layer of the cup set to adjust the inner pressure thereof. The control module controls the operation of the gas conveyor and a threshold setting mode of the pressure sensor. The pressure sensor detects the inner pressure of the air bag layer, so as to monitor and notify the control module to control the operation of the gas conveyor.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
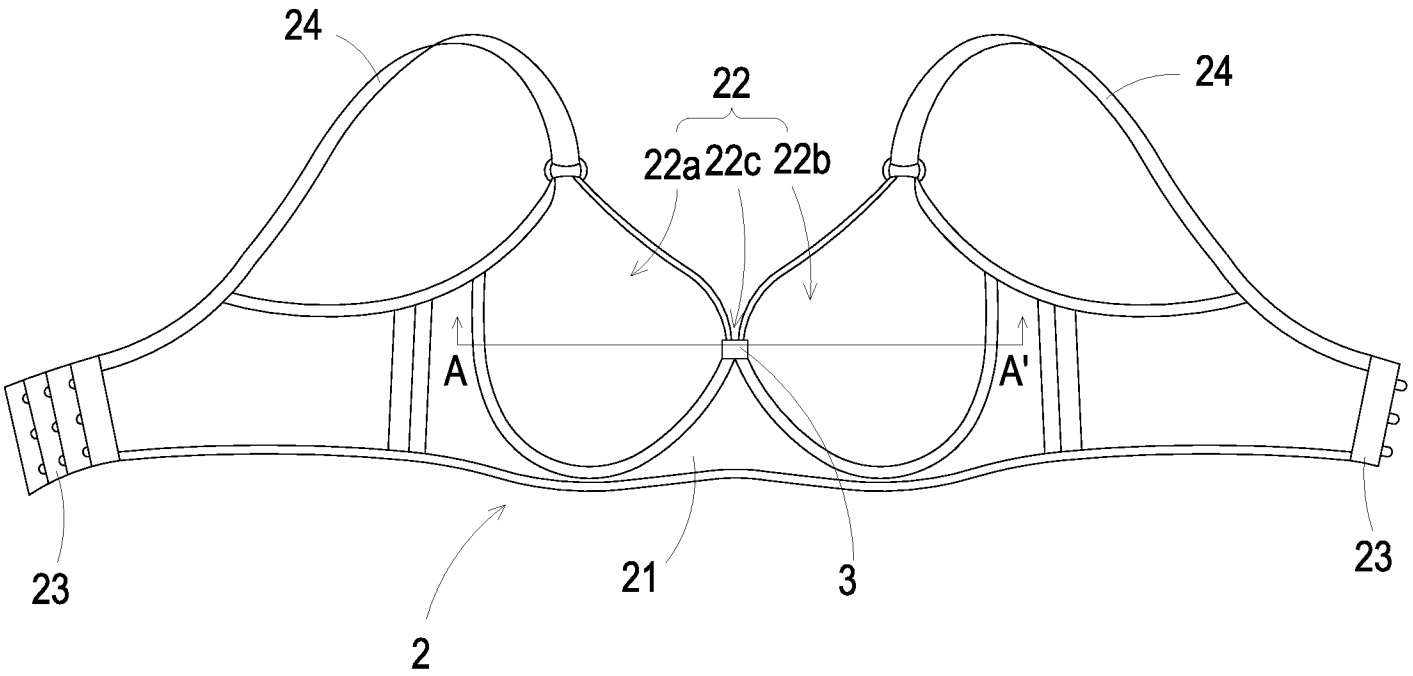
FIG. 1 is a front view illustrating an intelligent bra according to an embodiment of the present disclosure.

Please refer to FIG. 1. The present disclosure provides an intelligent bra, which includes a touch sensor 1, a main body 2 and a gas-collecting actuating device 3. The touch sensor 1 can detect the variation of the surface of breast. The detected data is delivered to a detection receiving device (such as a smart phone or an application program of computers) by the touch sensor 1. The detection receiving device analyses the detected data and delivers it to an intelligent medical detection apparatus. Consequently, the variation of breast is tracked and a notification is generated accordingly. If tumor cells are clustered in the breast, it may lead to blood aggregation at the site where said tumor cells cluster, so that the temperature is raised and the texture is changed. Consequently, the touch sensor 1 can detect the variation of the surface of breast, and track the texture, the color and the temperature of the breast.

The main body 2 includes a supporting base 21, a cup set 22 and two fixing elements 23. The supporting base 21 is worked as a connection component, which is configured to carry the cup set 22 and connected to the two fixing elements 23. The cup set 22 includes a first cup 22*a*, a second cup 22*b* and a central part 22*c* located therebetween. The first cup 22*a* and the second cup 22*b* are symmetrically disposed with respect to the central part 22*c*. The two fixing elements 23 are connected to two opposite sides of the supporting base 21, respectively. The two fixing elements 23 are configured to engage and connect with each other. The two fixing elements 23 may be a hook-and-eye closure system hook, but not limited thereto. In some embodiments, the two fixing elements 23 can also be fixing structures such as two magnets capable of attracting with each other, buttons, hooks and eyelets and so on. In some other embodiments, the intelligent bra further includes two back bands 24. The two back bands 24 respectively connect with two opposite lateral sides of the supporting base 21 to form a structure surrounding the user's body so that the intelligent bra is worn. The supporting base 21 and the two back bands 24 may be made by means of tailoring the soft cloth, and the cup set 22 may be made of one or more layers of cloth material.

Figure 2:
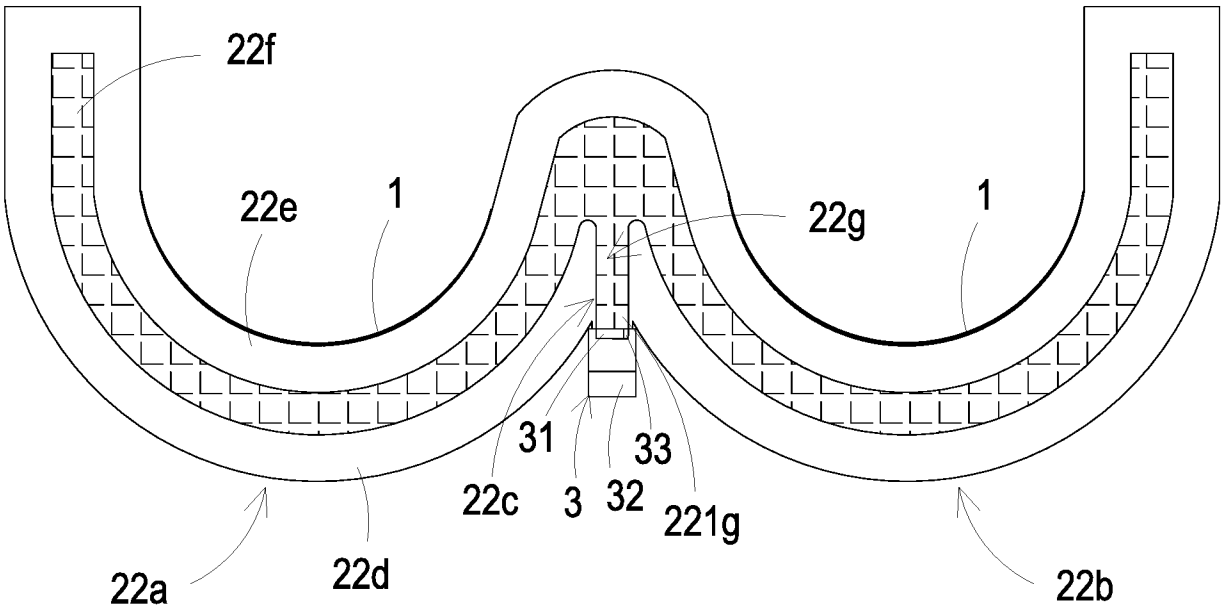
FIG. 2 is a cross-sectional view illustrating the intelligent bra at inflating state and taken along line A-A' of FIG. 1A.

Please refer to FIG. 1 and FIG. 2. In the embodiment, the cup set 22 of the main body 2 is formed by joining two fabric structures which may be sewed together. Furthermore, the cross-sectional structure of the cup set 22 includes an outer layer 22*d*, an inner layer 22*e* and an air bag layer 22*f*. The air bag layer 22*f* is disposed between the outer layer 22*d* and the inner layer 22*e* to be covered by both the outer layer 22*d* and the inner layer 22*e*. The outer layer 22*d* and the inner layer 22*e* can be made of two different fabric materials, but not limited thereto. The fabric materials can be varied according to the practical requirements. As to the air bag layer 22*f*, it is sandwiched between the outer layer 22*d* and the inner layer 22*e*, and the appearance and the arrangement of the air bag layer 22*f* can be varied according to the practical requirements. For example, the air bag layer 22*f* may be in the form of an arc of a half moon, and is correspondingly disposed at the lower edge of the first cup 22*a* and the second cup 22*b*, respectively. The size of the air bag layer 22*f* is approximately ⅓ cup size under this circumstance, but not limited thereto. In some other embodiments, the air bag layer 22*f* may be in form of ½ cup and covers half of the first cup 22*a* and half of the second cup 22*b*, respectively, but not limited thereto. In further other embodiments, the air bag layer 22*f* may be in form of full cup and covers the first cup 22*a* and the second cup 22*b* completely. From the above description, it can be seen that the type, the arrangement and the covering range of the air bag layer 22*f* is adjustable according to the practical requirements, and is not limited to the foregoing embodiments.

In addition, as shown in FIG. 2, in the embodiment, the air bag layer 22*f* further includes an airflow channel 22*g* in communication with the air bag layer 22*f*. The airflow channel 22*g* can be disposed within the air bag layer 22*f*. Further as shown in FIG. 2, a connection end 221*g* of the airflow channel 22*g* may extend along the central part 22*c* of the cup set 22 and protrude out from the outer layer 22*d* of the cup set 22, so as to allow the gas-collecting actuating device 3 to connect with the airflow channel 22*g*, but the arrangement is not limited thereto. In some embodiments, the connection end 221*g* of the airflow channel 22*g* can be disposed at any position of the cup set 22, for example, a lateral edge of the first cup 22*a* or the second cup 22*b*, but not limited thereto. The arrangement of the connection end 221*g* can be adjustable according to the position of the external device to be connected with. In the embodiment, the gas-collecting actuating device 3 is correspondingly disposed at the central part 22*c* of the cup set 22 and detachably connected with the connection end 221*g* of the airflow channel 22*g* of the air bag layer 22*f*, but not limited thereto. In some embodiments, the gas-collecting actuating device 3 can be a fixed structure and similarly connected with the connection end 221*g* of the airflow channel 22*g*, but the arrangement is not limited thereto. Thus, the gas-collecting actuating device 3 is allowed to suck in or vent the air through the connection end 221*g* of the airflow channel 22*g*, by which the air bag layer 22*f* is inflated or deflated and an inner pressure of the air bag layer 22*f* is adjusted. In this way, by controlling the gas-collecting actuating device 3, the user can adjust the air bag layer 22*f* of the cup set 22 to adjust the hardness, the appearance and the support strength of the first cup 22*a* and the second cup 22*b*, according to the shape of the breasts. Therefore, stable support and lift are provided and the pushing-up-and-together effect of the intelligent bra is achieved. In the embodiment, the touch sensor 1 is attached on the inner layer 22*e* of the cup set 22. Due to the inner pressure of the air bag layer 22*f* is adjusted by the gas-collecting actuating device 3, the first cup 22*a* and the second cup 22*b* are inflated to push the touch sensor 1 to closely fit the surface of the breasts, so that the touch sensor 1 can detect the variation of the surface of the breast. Consequently, the detection accuracy of the touch sensor 1 is enhanced.

Figure 3:
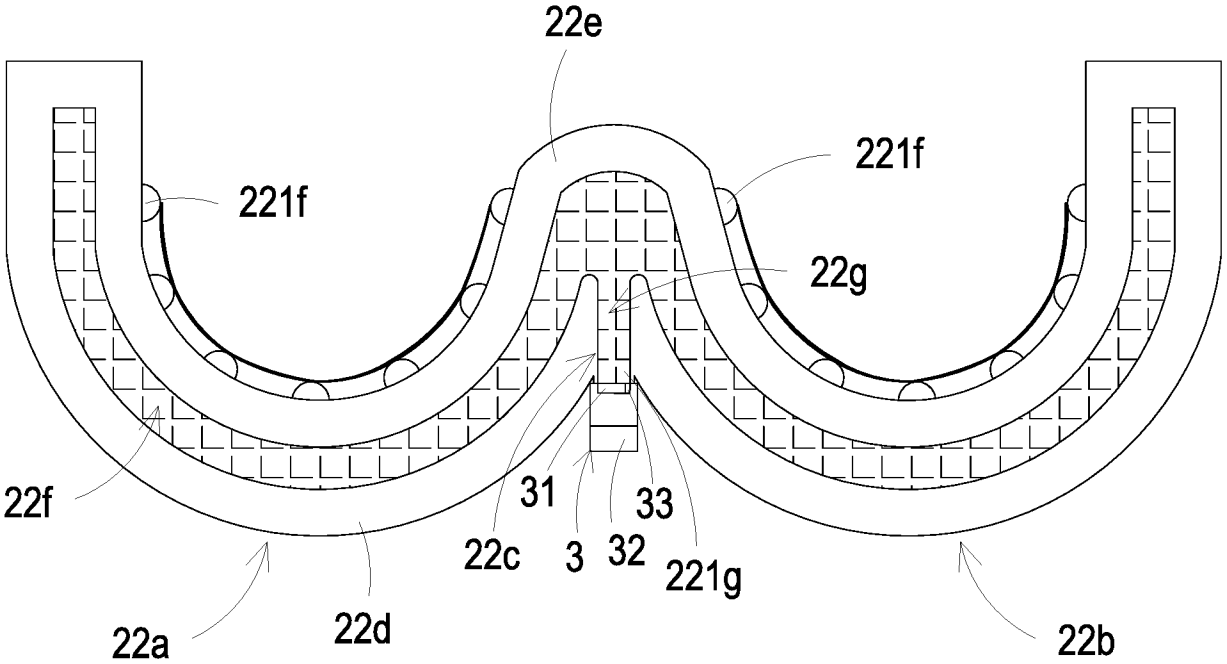
FIG. 3 is a cross-sectional view illustrating an intelligent bra at inflating state according to another embodiment of the present disclosure.

Please refer to FIG. 3. FIG. 3 is a cross-sectional view illustrating an intelligent bra at inflating state according to another embodiment of the present disclosure. Please refer to FIG. 3. In the embodiment, the cup set 22 of the intelligent bra includes an outer layer 22*d*, an inner layer 22*e* and an air bag layer 22*f* similar to those of the embodiment of FIG. 2 so are not redundantly described herein. In the embodiment, the intelligent bra further includes plural air bag air bag protrusions 221*f* disposed on the inner layer 22*e* of the cup set 22 of the main body 2 and distributed over the first cup 22*a* and the second cup 22*b*. Furthermore, the plural air bag air bag protrusions 221*f* may be in communication with the air bag layer 22*f*, so that the touch feeling of the plural air bag air bag protrusions 221*f* is adjustable since the inner pressure of the air bag layer 22*f* is adjustable through inflation and deflation by the gas-collecting actuating device 3. For example, in an event of inflation, the plural air bag protrusions 221*f* may be hardened by increasing the inner pressure of the air bag layer 22*f*, thereby being able to push the touch sensor 1 to adjust according to the shape of user's breasts, and closely fit the surface of the breasts, so that the touch sensor 1 can detect the variation of the surface of the breast. Consequently, the detection accuracy of the touch sensor 1 is enhanced.

The gas-collecting actuating device 3 described above is in fluid communication with the airflow channel 22*g* of the air bag layer 22*f*. The gas-collecting actuating device 3 is configured to adjust the inner pressure of the air bag layer 22*f*. The gas-collecting actuating device 3 includes a gas conveyor 31, a control module 32 and a pressure sensor 33. The control module 32 controls the operations of opening and closing of the gas conveyor 31, and also controls a threshold setting mode of the pressure sensor 33. The pressure sensor 33 is configured to detect the inner pressure of the air bag layer 22*f*. When the inner pressure of the air bag layer 22*f* reaches the setting threshold value, the control module 32 is notified immediately to control the shutdown operation of the gas conveyor 31, so as to achieve an intelligent control operation. In other words, the user can control the threshold setting mode of the pressure sensor 33 through the control module 32, so that the user can appropriately adjust the setting threshold value of the inflation amount of the air bag layer 22*f* in the cup set 22, and the opening and closing operation time of the gas conveyor 31 (i.e., on/off time ratio of the miniature pump 311) is controlled thereby. Consequently, the hardness, the appearance and the support strength of the first cup 22*a* and the second cup 22*b* can be arbitrarily adjustable to meet the demand of the user and achieve the effects of supporting stably, pushing up and intelligent saving power.

Please refer to FIG. 2, FIG. 3 and FIGS. 4A to 4D. In the embodiment, the gas conveyor 31 is constructed in and in communication with the connection end 221*g* of the airflow channel 22*g*. The gas conveyor 31 includes a miniature pump 311, a gas-collecting seat 312, a chamber plate 313, a valve membrane 314 and a valve switch 315. The gas-collecting seat 312 includes a gas-collecting slot 312*a* concavely formed on a bottom surface, which is in fluid communication with the connection end 221*g* of the airflow channel 22*g*. The gas-collecting seat 312 further includes a first gas-collecting chamber 312*b* and a first pressure-releasing chamber 312*c* formed on a top surface of the gas-collecting seat 312. In the embodiment, a gas-collecting perforation 312*d* is formed and disposed between the gas-collecting slot 312*a* and the first gas-collecting chamber 312*b* to allow the gas-collecting slot 312*a* and the first gas-collecting chamber 312*b* to communicate with each other. The first gas-collecting chamber 312*b* and the first pressure-releasing chamber 312*c* are separated apart on the top surface of the gas-collecting seat 312. A communication channel 312*e* is disposed between the first gas-collecting chamber 312*b* and the first pressure-releasing chamber 312*c* to allow the first gas-collecting chamber 312*b* and the first pressure-releasing chamber 312*c* to communicate with each other. In the embodiment, a first protrusion 312*f* is formed in the first pressure-releasing chamber 312*c* and a pressure-releasing perforation 312*g* is disposed at a center of the first protrusion 312*f*. The pressure-releasing perforation 312*g* is in fluid communication with the first pressure-releasing chamber 312*c* and the valve switch 315. The valve switch 315 is a switch and is configured to control the pressure-releasing perforation 312*g* to be in an open state or in a close state. Moreover, the opening and closing operations of the valve switch 315 is controlled by the control module 32.

As shown in FIG. 2 and FIG. 3. In the embodiment, the connection end 221*g* of the airflow channel 22*g* covers and seals the gas-collecting slot 312*a*, so that the air bag layer 22*f* is in fluid communication with the gas-collecting slot 312*a* and the gas-collecting perforation 312*d*. In addition, the chamber plate 313 is carried and disposed on the gas-collecting seat 312. In the embodiment, the chamber plate 313 includes a second gas-collecting chamber 313*a* and a second pressure-releasing chamber 313*b* formed on a top surface spatially corresponding to the gas-collecting seat 312. The second gas-collecting chamber 313*a* and the second gas-collecting chamber 313*a* are matched and sealed with each other. A second protrusion 313*c* is formed in the second gas-collecting chamber 313*a*, and a communication chamber 313*d* is concavely formed on a bottom surface of the chamber plate 313 opposite to the second gas-collecting chamber 313*a* and the second pressure-releasing chamber 313*b*. The miniature pump 311 is carried and disposed on the chamber plate 313 to seal and cover the communication chamber 313*d*, and at least one communication aperture 313*e* communicates with the communication chamber 313*d* and is in fluid communication with the second gas-collecting chamber 313*a* and the second pressure-releasing chamber 313*b*. Moreover, the valve membrane 314 is disposed between the gas-collecting seat 312 and the chamber plate 313 and abutted against the first protrusion 312*f* to seal the pressure-releasing perforation 312*g*. The valve membrane 314 has a valve aperture 314*a* disposed at a position abutted against the second protrusion 313*c*, and the valve aperture 314*a* is abutted against by the second protrusion 313*c* to be sealed.

Please refer to FIG. 5A, FIG. 5B and FIGS. 6A to 6E. In the embodiment, the miniature pump 311 includes a gas inlet plate 3111, a resonance plate 3112, a piezoelectric actuator 3113, a first insulation plate 3114, a conducting plate 3115 and a second insulation plate 3116. The gas inlet plate 3111, the resonance plate 3112, the piezoelectric actuator 3113, the first insulation plate 3114, the conducting plate 3115 and the second insulation plate 3116 are stacked sequentially.

The gas inlet plate 3111 has at least one inlet aperture 3111*a*, at least one convergence channel 3111*b* and a convergence chamber 3111*c*. The inlet aperture 3111*a* allows a gas to flow in. The convergence channel 3111*b* is disposed correspondingly to the inlet aperture 3111*a* and guides the gas from the inlet aperture 3111*a* toward the convergence chamber 3111*c*. In the embodiment, the number of the inlet apertures 3111*a* and the number of the convergence channels 3111*b* are the same. Preferably but not exclusively, there are four inlet apertures 3111*a* and four convergence channels 3111*b*. The four inlet apertures 3111*a* are in fluid communication with the four convergence channels 3111*b*, respectively, and the four convergence channels 3111*b* guide the gas to the convergence chamber 3111*c*.

In the embodiment, the resonance plate 3112 is assembled with the gas inlet plate 3111 by means of adhesion. The resonance plate 3112 has a central aperture 3112*a*, a movable part 3112*b* and a fixing part 3112*c*. The central aperture 3112*a* is disposed at a center of the resonance plate 3112 and aligned with the convergence chamber 3111*c* of the gas inlet plate 3111. The movable part 3112*b* surrounds the central aperture 3112*a* and spatially corresponds to the convergence chamber 3111*c*. The fixing part 3112*c* is located at a peripheral portion of the resonance plate 3112 and is attached on the gas inlet plate 3111.

In the embodiment, the piezoelectric actuator 3113 includes a suspension plate 3113*a*, an outer frame 3113*b*, at least one bracket 3113*c*, a piezoelectric element 3113*d*, at least one vacant space 3113*e* and a bulge 3113*f*. Preferably but not exclusively, the suspension plate 3113*a* is a square suspension plate. Compared with the design of the circular suspension plate, the square structure of the suspension plate 3113*a* obviously has the advantage of power saving. Since the power consumption of the capacitive load operating at the resonant frequency is increased as the frequency is increased, and the resonance frequency of the square suspension plate 3113*a* is obviously lower than that of the circular suspension plate. The relative power consumption of the square suspension plate is obviously lower than that of circular suspension plate. Therefore, the suspension plate 3113*a* is designed in a square type. Namely, the suspension plate 3113*a* square-designed of the present disclosure is advantageous of power saving. In the embodiment, the outer frame 3113*b* is arranged around the suspension plate 3113*a*. The at least one bracket 3113*c* is connected between the suspension plate 3113*a* and the outer frame 3113*b* for elastically supporting the suspension plate 3113*a*. In the embodiment, a length of a side of the piezoelectric element 3113*d* is smaller than or equal to a length of a side of the suspension plate 3113*a*, and the piezoelectric element 3113*d* is attached on a surface of the suspension plate 3113*a* to drive the suspension plate 3113*a* to undergo the bending vibration in response to an applied voltage. The at least one vacant space 3113*e* is formed among the suspension plate 3113*a*, the outer frame 3113*b* and the bracket 3113*c* to allow the gas flow therethrough. In the embodiment, the suspension plate 3113*a* has a first surface and a second surface, and the bulge 3113*f* is disposed on the second surface opposite to the first surface attached to the piezoelectric element 3113*d*. In the embodiment, the bulge 3113*f* is formed by an etching process, and a convex structure is formed on the second surface opposite to the first surface of the suspension plate 3113*a* attached to the piezoelectric element 3113*d*. More specifically, the bulge 3113*f* and the suspension plate 3113*a* may be integrally formed from one substrate by using the etching process. The substrate may be etched to form a plate (suspension plate 3113*a*) and the convex structure (bulge 3113*f*) protruded from the surface of the plate.

In the embodiment, the gas inlet plate 3111, the resonance plate 3112, the piezoelectric actuator 3113, the first insulation plate 3114, the conducting plate 3115 and the second insulation plate 3116 are stacked sequentially. A chamber space 3117 is formed between suspension plate 3113*a* and the resonance plate 3112. Preferably but not exclusively, the chamber space 3117 may be utilized a filler, for example but not limited to a conductive adhesive, to fill a gap generated between the resonance plate 3112 and the outer frame 3113*b* of the piezoelectric actuator 3113, so that a specific depth between the resonance plate 3112 and the suspension plate 3113*a* can be maintained and thus the gas is introduced to flow more rapidly. Moreover, since the proper distance between the suspension plate 3113*a* and the resonance plate 3112 is maintained, the contact interference is reduced and the generated noise is largely reduced. In some embodiments, alternatively, the height of the outer frame 3113*b* of the piezoelectric actuator 3113 is increased, so that the thickness of the conductive adhesive filled within the gap between the resonance plate 3112 and the outer frame 3113*b* of the piezoelectric actuator 3113 may be reduced. Thus, in the case where the suspension plate 3113*a* and the resonance plate 3112 are maintained at a proper distance, the thickness of the conductive adhesive filled within the overall assembly of the miniature pump 311 won't be affected by a hot pressing temperature and a cooling temperature, and it benefits from avoiding that the conductive adhesive affects the actual size of the chamber space 3117 due to the factors of thermal expansion and contraction after the assembly is completed. The present disclosure is not limited thereto. In addition, the transportation efficiency of the miniature pump 311 is affected by the chamber space 3117, so that the chamber space 3117 maintained in a fixed size is important to provide stable transportation efficiency for the miniature pump 311.

Figure 6A:
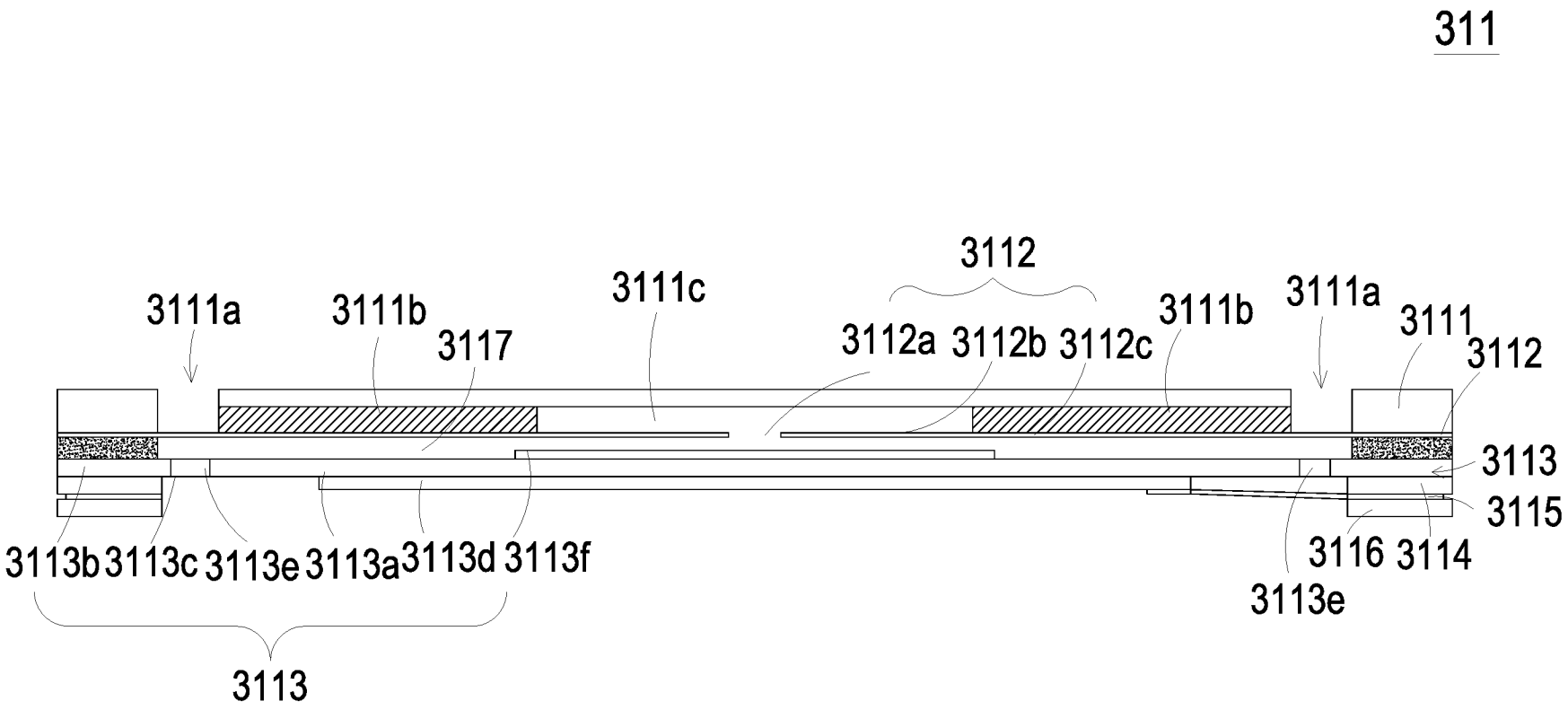
FIG. 6A is a cross-sectional view illustrating the miniature pump of FIG. 5A.
Figure 6B:
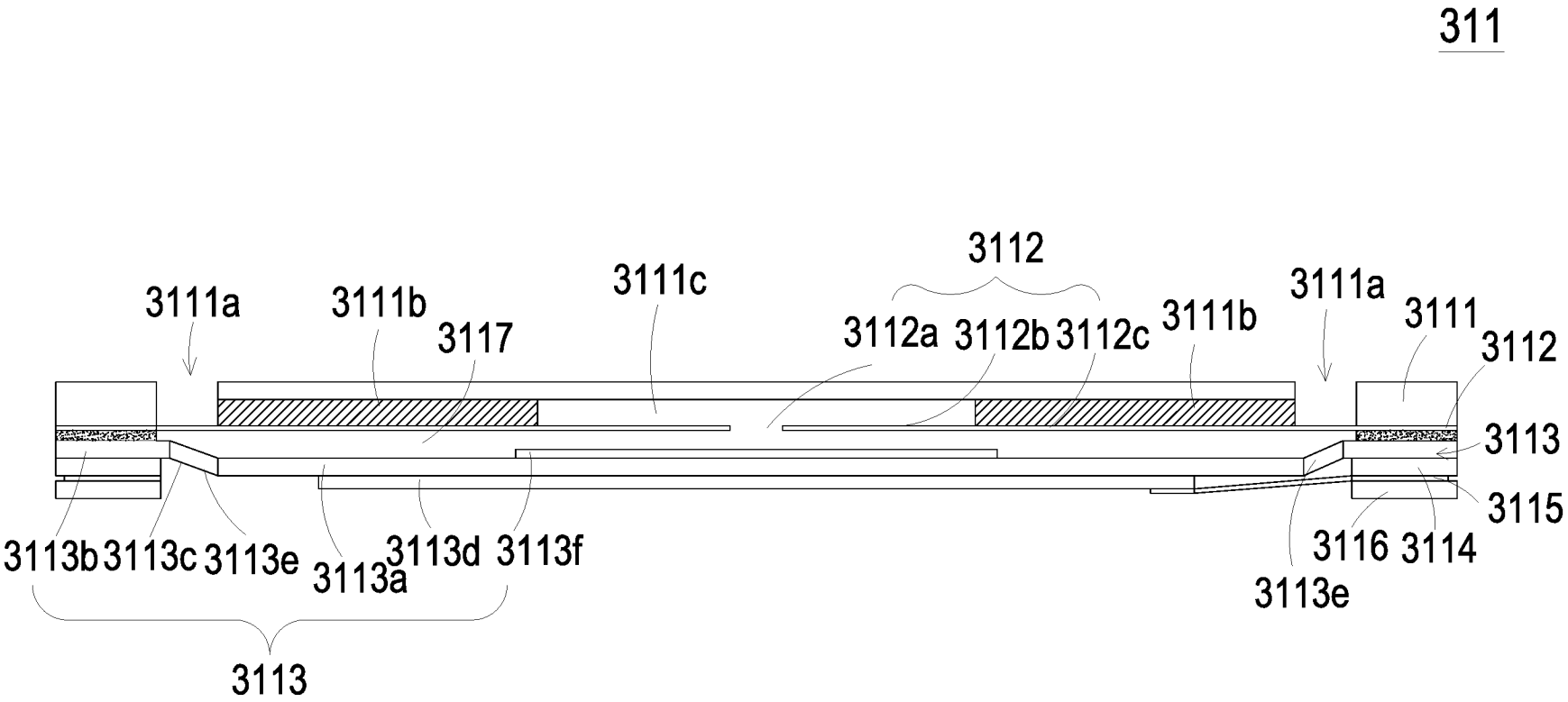
FIG. 6B is a cross-sectional view illustrating a miniature pump according to another embodiment of the present disclosure.

Please refer to FIG. 6B. In another exemplary structure of the piezoelectric actuator 3113, the suspension plate 3113*a* can be formed by a stamping method. The stamping method makes the suspension plate 3113*a* extended outwardly at a distance, and the distance extended outwardly may be adjusted by the bracket 3113*c* formed between the suspension plate 3113*a* and the outer frame 3113*b*, so that a surface of the bulge 3113*f* on the suspension plate 3113*a* is not coplanar with a surface of the outer frame 3113*b*. A small amount of a filling material, for example a conductive adhesive, is applied to the assembly surface of the outer frame 3113*b* to attach the piezoelectric actuator 3113 on the fixing part 3112*c* of the resonance plate 3112 by means of hot pressing, so that the piezoelectric actuator 3113 is assembled with the resonance plate 3112. In this way, the entire structure may be improved by adopting the stamping method to form the suspension plate 3113*a* of the piezoelectric actuator 3113, thereby modifying the chamber space 3117. A desired size of the chamber space 3117 may be satisfied by simply adjusting the distance as described made by the stamping method. It simplifies the structural design for adjusting the chamber space 3117. At the same time, it achieves the advantages of simplifying the process and saving the process time. In the embodiment, the first insulation plate 3114, the conducting plate 3115 and the second insulation plate 3116 are all frame-shaped thin sheet, and stacked sequentially on the piezoelectric actuator 3113 to obtain the entire structure of the miniature pump 311.

Figure 6C:
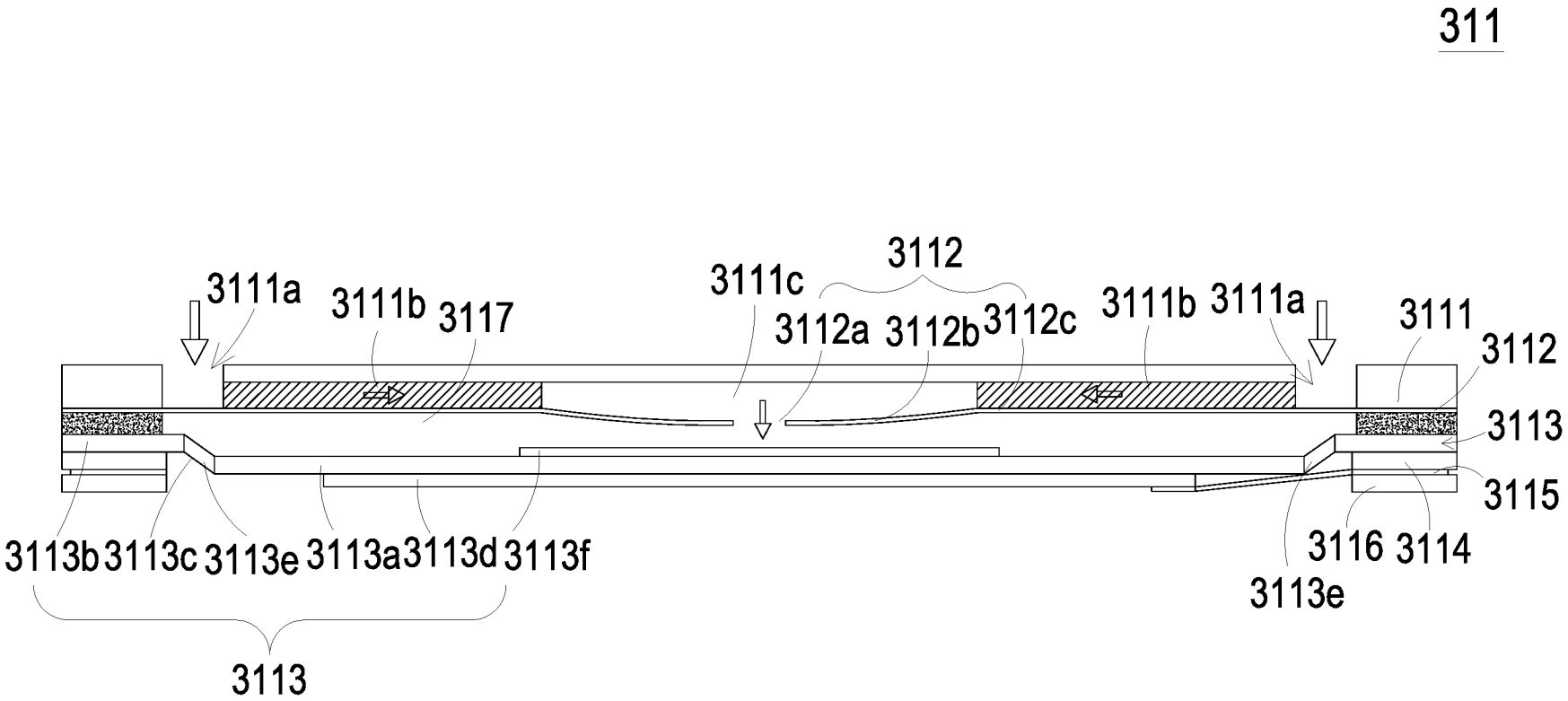
FIGS. 6C to 6E illustrate an operating process of the miniature pump of FIG. 6A.
Figure 6D:
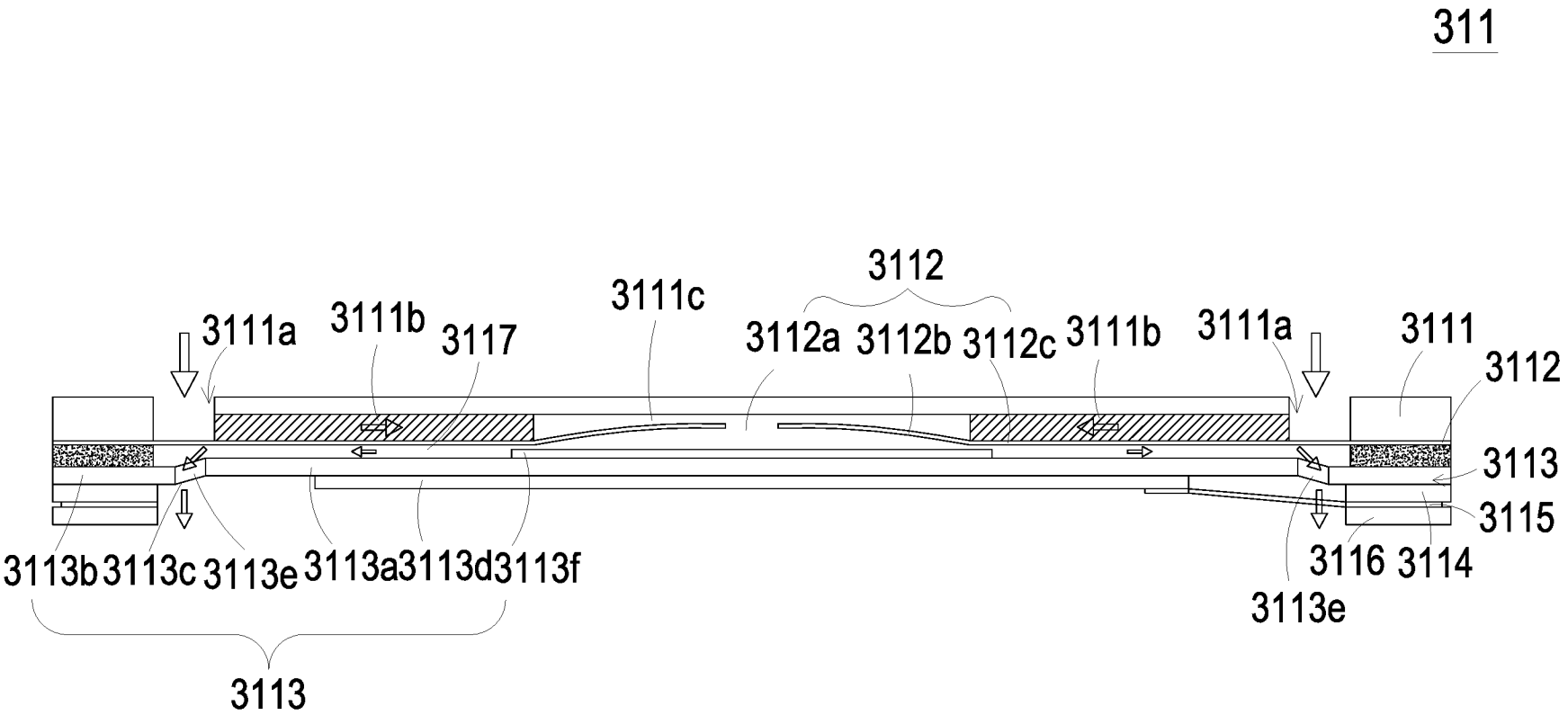
Figure 6E:
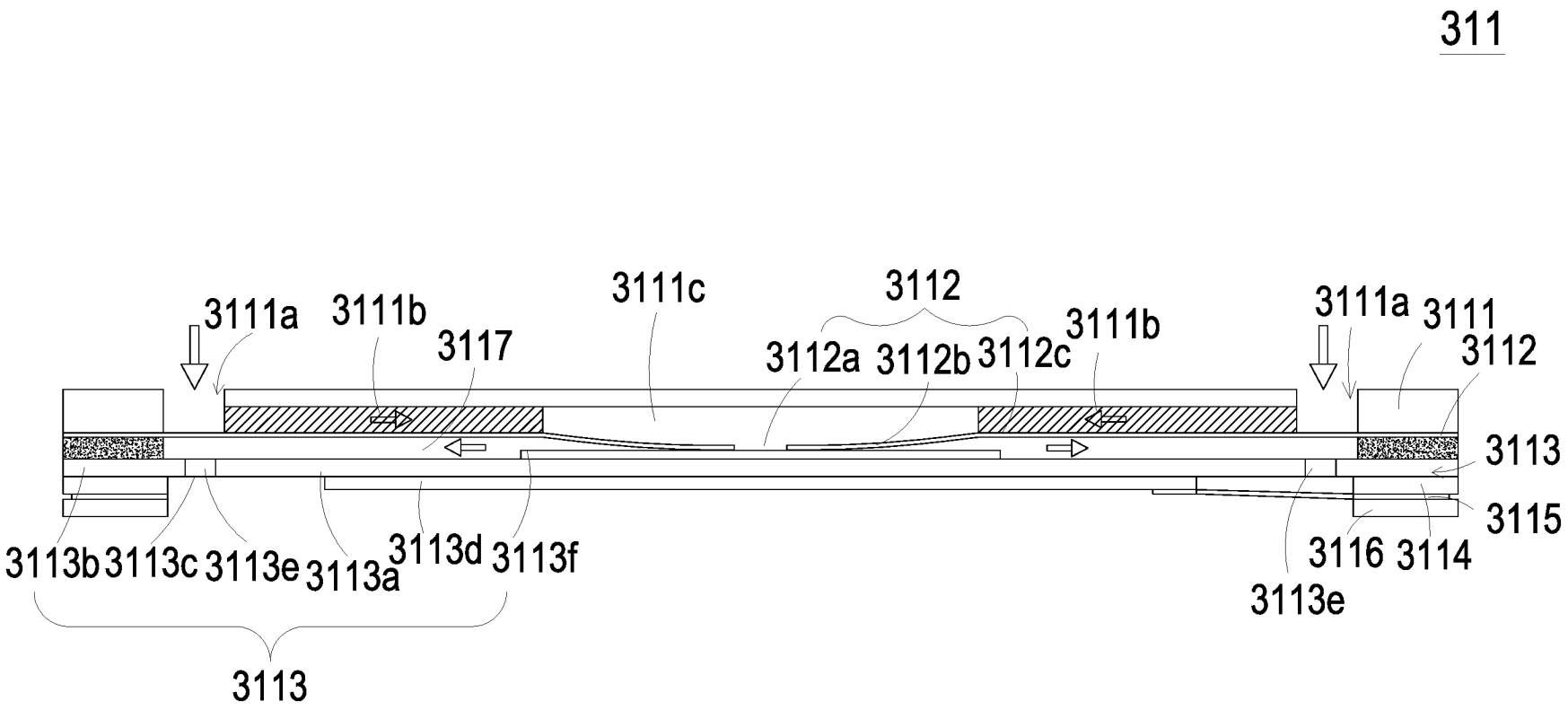
Figure 7:
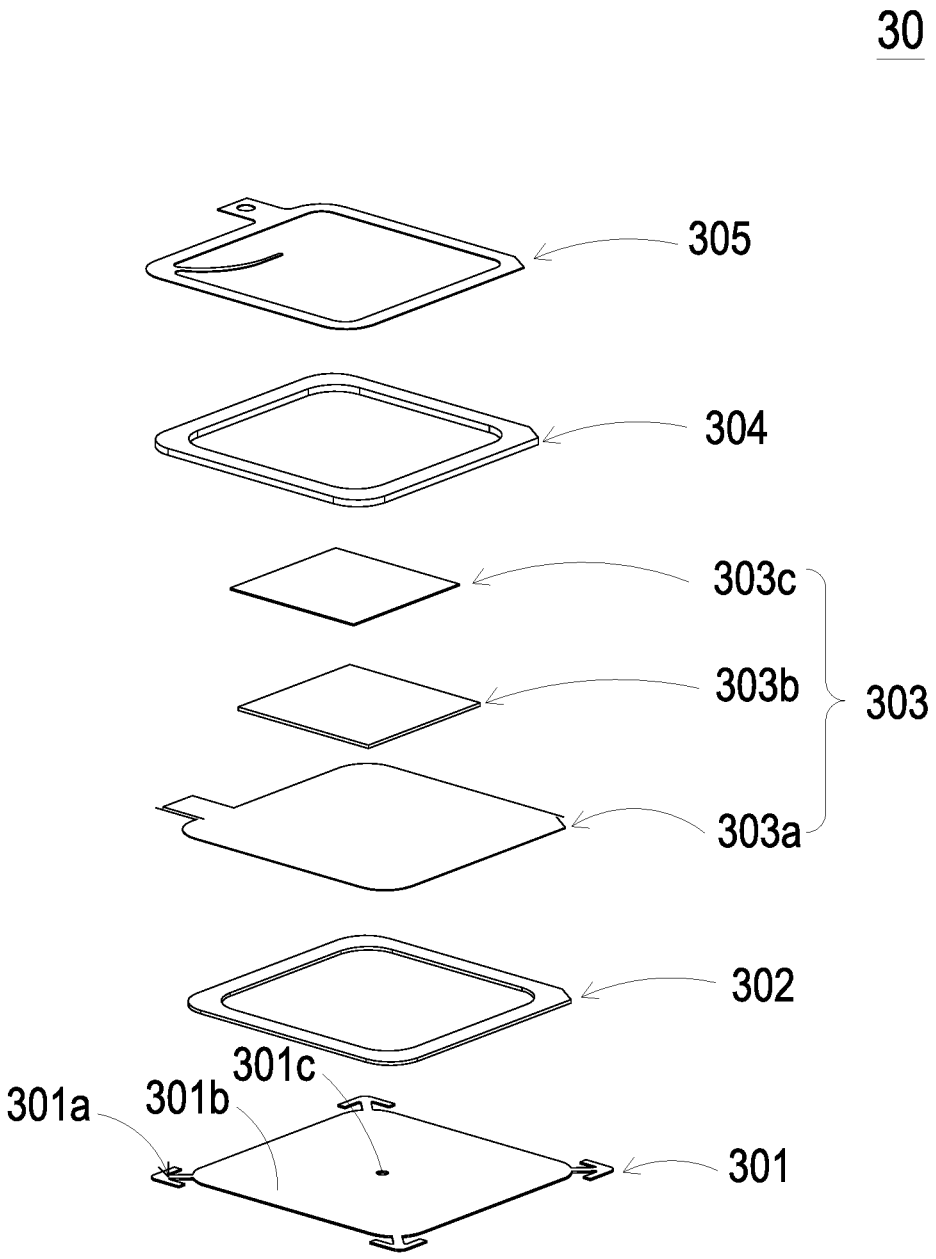
FIG. 7 is a schematic exploded view illustrating a blast miniature pump according to an embodiment of the present disclosure.

For describing the actions of the miniature pump 311, please refer to FIGS. 6C to 6E. Firstly, as shown in FIG. 6C, when the piezoelectric element 3113*d* of the piezoelectric actuator 3113 is deformed in response to an applied voltage, the suspension plate 3113*a* is displaced in a direction away from the gas inlet plate 3111. In that, the volume of the chamber space 3117 is increased, a negative pressure is formed in the chamber space 3117, and the gas in the convergence chamber 3111*c* is inhaled into the chamber space 3117. At the same time, the resonance plate 3112 is in resonance and thus displaced synchronously in the direction away from the gas inlet plate 3111. Thereby, the volume of the convergence chamber 3111*c* is increased. Since the gas in the convergence chamber 3111*c* flows into the chamber space 3117, the convergence chamber 3111*c* is also in a negative pressure state, and the gas is sucked into the convergence chamber 3111*c* by flowing through the inlet aperture 3111*a* and the convergence channel 3111*b*. Then, as shown in FIG. 6D, the piezoelectric element 3113*d* drives the suspension plate 3113*a* to be displaced toward the gas inlet plate 3111 to compress the chamber space 3117. Similarly, the resonance plate 3112 is actuated by the suspension plate 3113*a* (i.e., in resonance with the suspension plate 3113*a*) and is displaced toward the gas inlet plate 3111. Thus, the gas in the chamber space 3117 is compressed synchronously and forced to be further transported through the vacant space 3113*e* to achieve the effect of gas transportation. Finally, as shown in FIG. 6E, when the suspension plate 3113*a* is vibrated back to the initial state, which is not driven by the piezoelectric element 3113*d*, the resonance plate 3112 is also driven to displace in the direction away from the gas inlet plate 3111 at the same time. In that, the resonance plate 3112 pushes the gas in the chamber space 3117 toward the vacant space 3113*e*, and the volume of the convergence chamber 3111*c* is increased. Thus, the gas can continuously flow through the inlet aperture 3111*a* and the convergence channel 3111*b* and be converged in the convergence chamber 3111*c*. By repeating the actions of the miniature pump 311 shown in the above-mentioned FIGS. 6C to 6E continuously, the miniature pump 311 can continuously transport the gas at a high speed to accomplish the gas transportation and output operations of the miniature pump 311.

Please refer to FIG. 6A. In the embodiment, the gas inlet plate 311, the resonance plate 3112, the piezoelectric actuator 3113, the first insulation plate 3114, the conducting plate 3115 and the second insulation plate 3116 are all produced by a micro-electromechanical surface micromachining technology. Thereby, the volume of the miniature pump 311 is reduced and a microelectromechanical system (MEMS) of the miniature pump 311 is constructed.

Figure 4A:
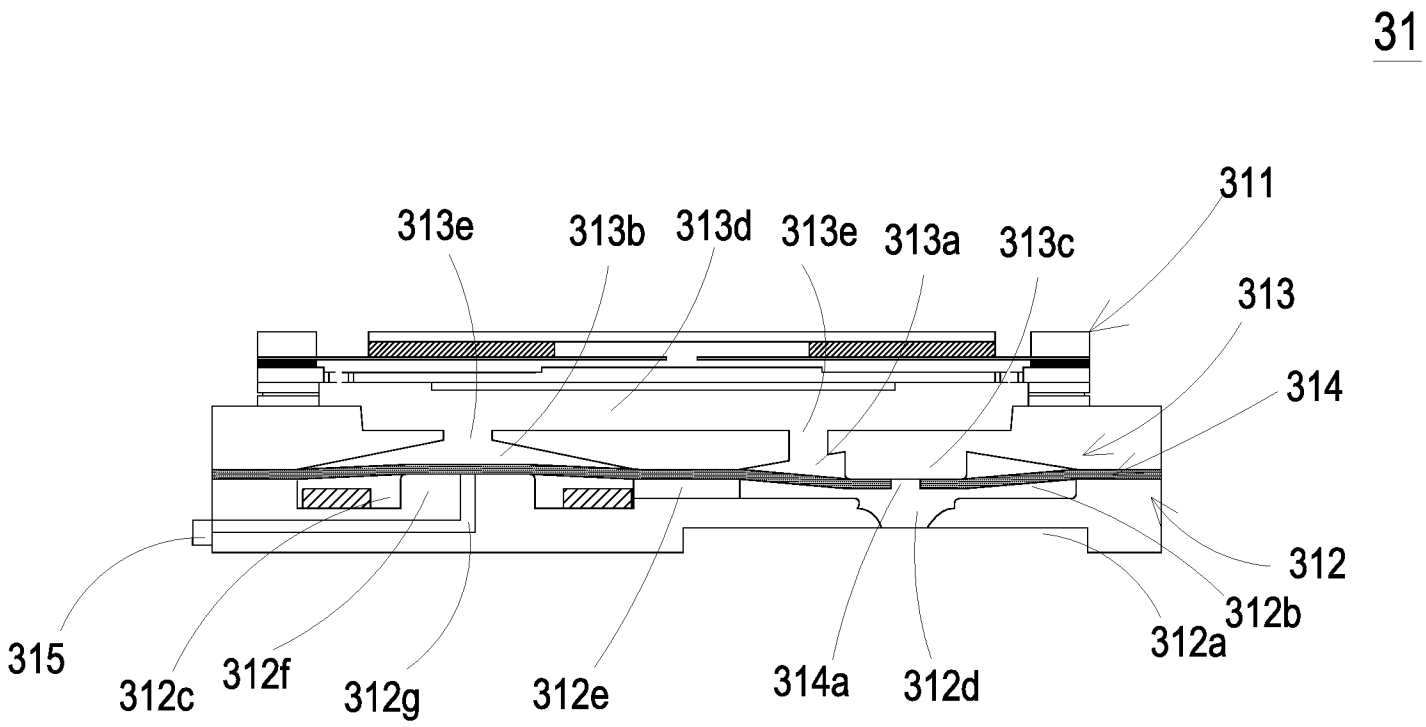
FIG. 4A is cross-sectional view illustrating a gas conveyor according to an embodiment of the present disclosure.
Figure 4B:
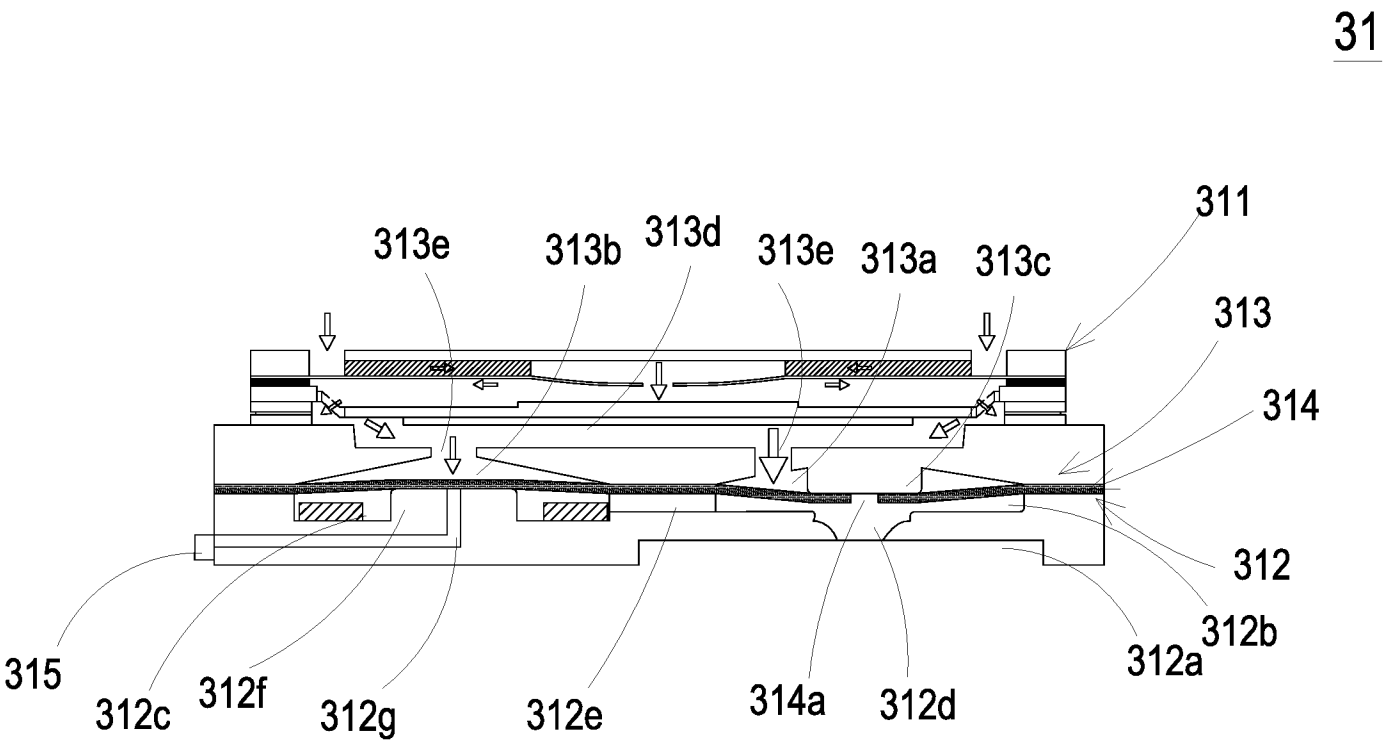
FIGS. 4B to 4C illustrate an inflating process of the gas conveyor of FIG. 4A.
Figure 4C:
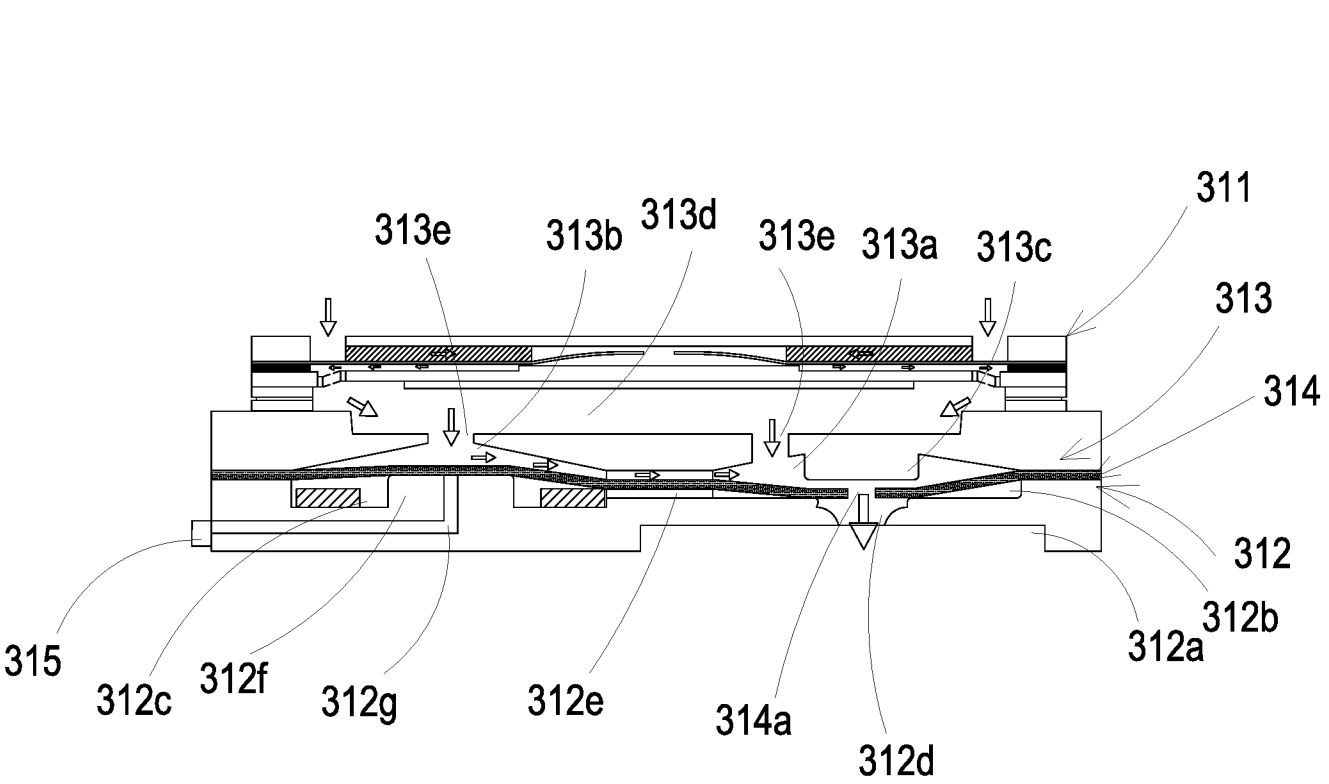
Figure 4D:
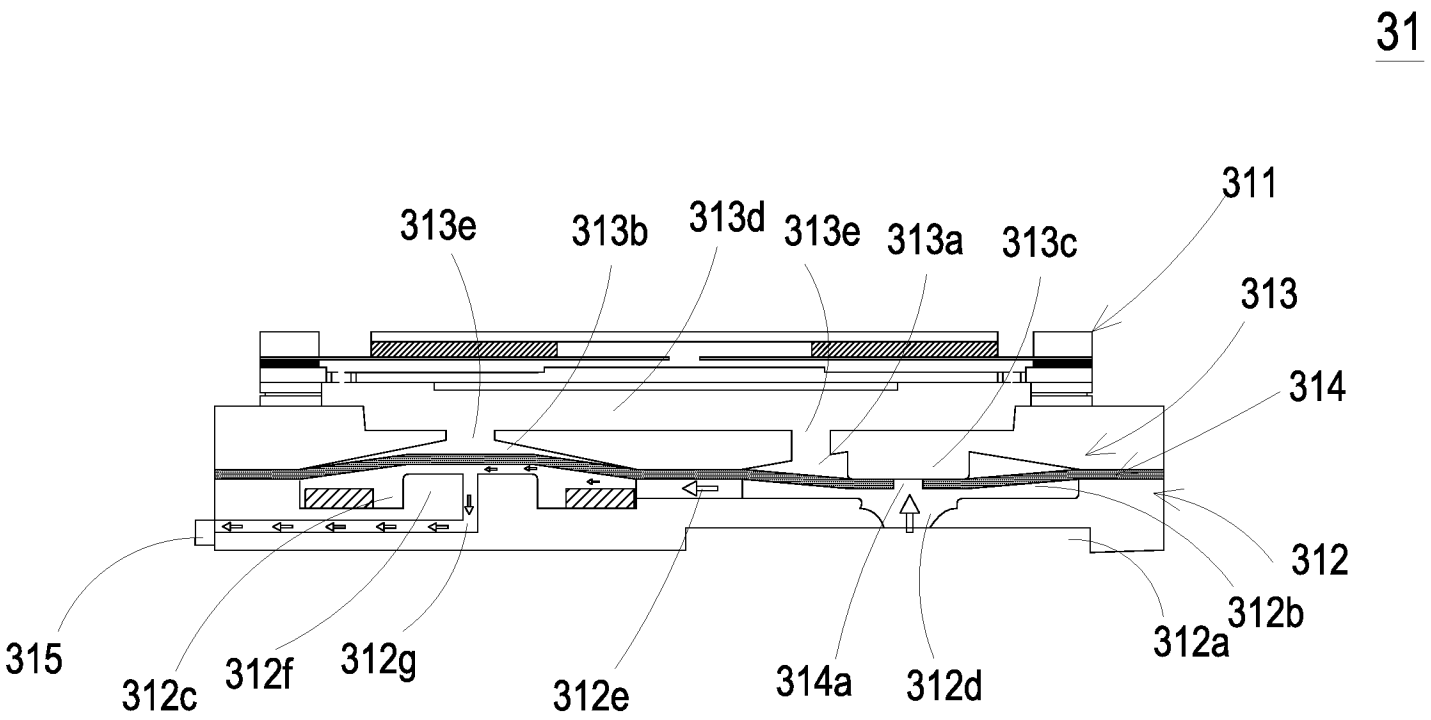
FIG. 4D illustrates a deflating process of the gas conveyor of FIG. 4A.
Figure 5A:
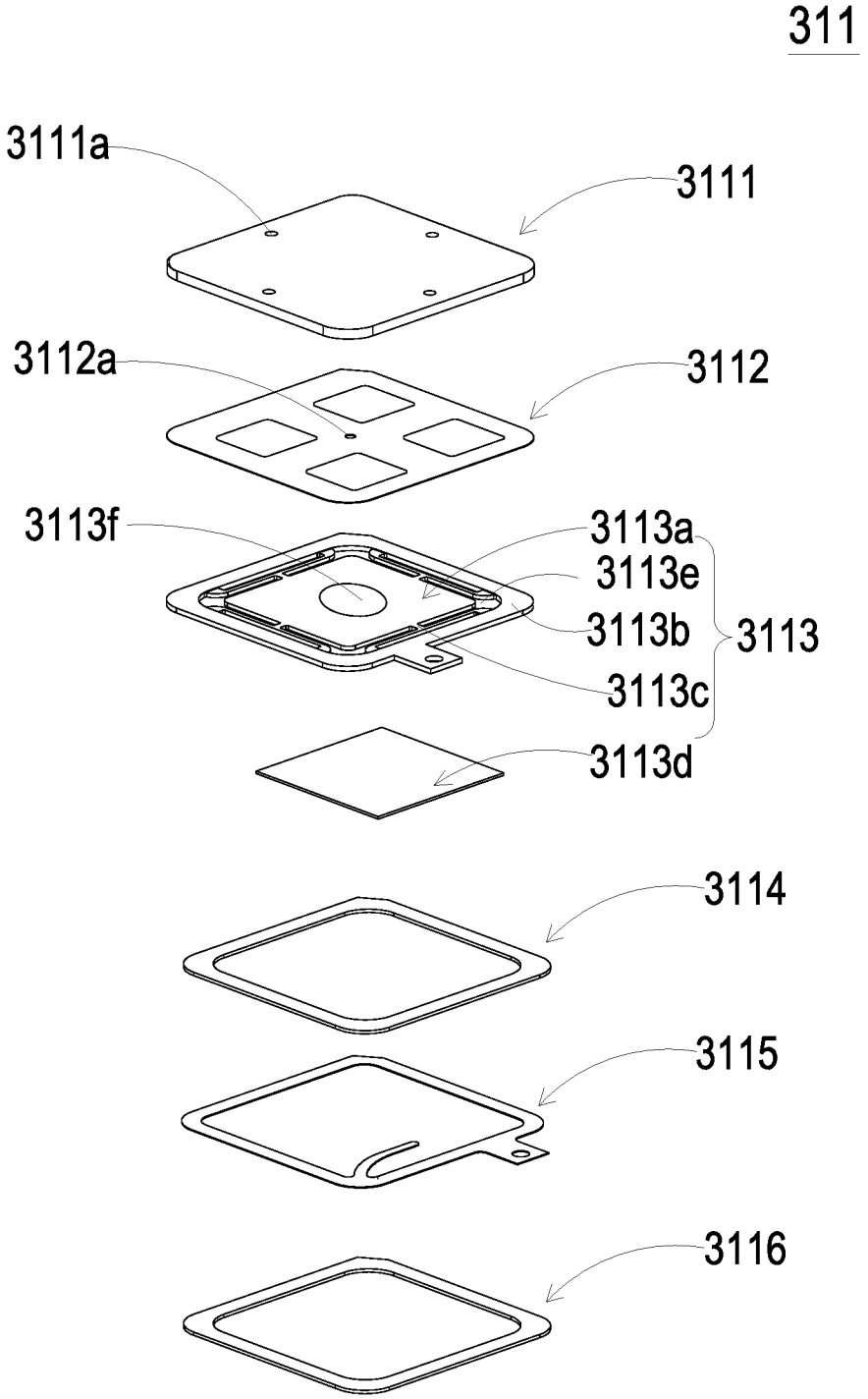
FIG. 5A is a schematic exploded view illustrating a miniature pump according to an embodiment of the present disclosure.
Figure 5B:
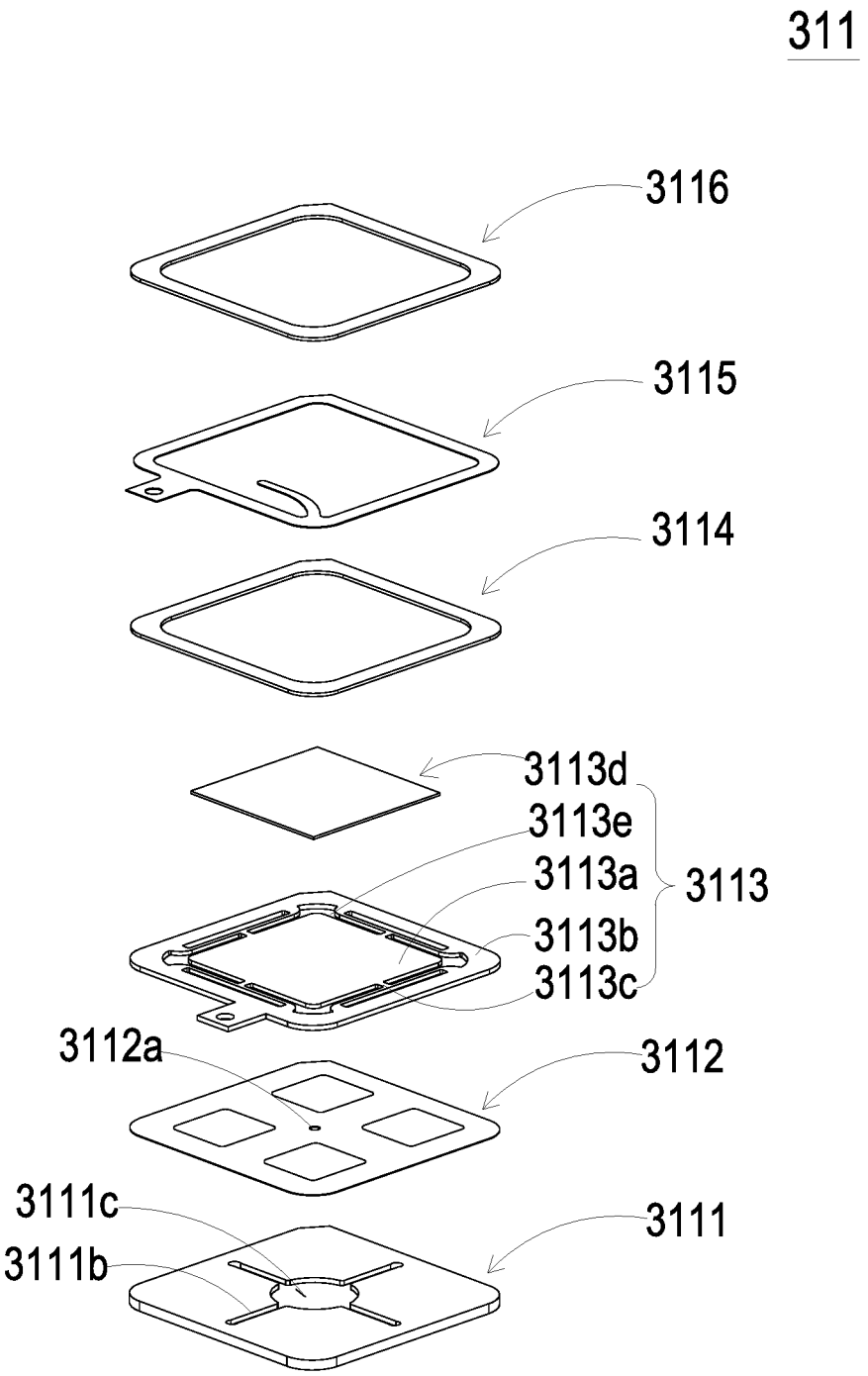
FIG. 5B a schematic exploded view illustrating the miniature pump of FIG. 5A in different angle of view.

According to the above descriptions, please refer to FIGS. 4B and 4C. When the miniature pump 311 is controlled by the control module 32 and driven to transport a gas, the gas is inhaled from outside of the miniature pump 311 and transported to the communication chamber 313*d*, and then the gas is transported from the communication chamber 313*d* to the second gas-collecting chamber 313*a* and the second pressure-releasing chamber 313*b* through the communication aperture 313*e*. Consequently, the valve membrane 314 is pushed to move apart from the second protrusion 313*c*. The valve membrane 314 is pushed to abut against the first protrusion 312*f* and to seal the pressure-releasing perforation 312*g*. Moreover, the gas in the second pressure-releasing chamber 313*b* is transported into the second gas-collecting chamber 313*a* through the communication channel 312*e* and further transport into the second gas-collecting chamber 313*a* of the gas-collecting seat 312 through the valve aperture 314*a* of the valve membrane 314. In that, the gas is converged to the gas-collecting slot 312*a* in fluid communication with the gas-collecting perforation 312*d*, and the air bag layer 22*f* is inflated (as shown in FIG. 2) and the inner pressure of the air bag layer 22*f* can be adjusted. After the air bag layer 22*f* is inflated for the period of time and the inflation operation is stopped, as shown in FIG. 4D, the miniature pump 311 stops transporting gas. Under this circumstance, the gas pressure of the air bag layer 22*f* is greater than that of the communication chamber 313*d*. The gas converged in the air bag layer 22*f* pushes the valve membrane 314 to move and abut against the second protrusion 313*c*, the valve aperture 314*a* is sealed, and the gas pushes the valve membrane 314 to move and part from the first protrusion 312*f* to open the pressure-releasing perforation 312*g*. The valve switch 315 is controlled by the control module 32 and in the open state, so that the gas is discharged out of the miniature pump 311 through the pressure-releasing perforation 312*g*. The gas converged in the air bag layer 22*f* is transported to the pressure-releasing perforation 312*g* and discharged out from the gas conveyor 31, so that a pressure-releasing operation of the air bag layer 22*f* is performed.

In the embodiment, the gas is transported to the airflow channel 22*g* through the continuous actuation of the gas conveyor 31 of the gas-collecting actuating device 3, and guided to the air bag layer 22*f* to be inflated. In addition, the inflation amount of the air bag layer 22*f* can be monitored by the threshold setting mode of the pressure sensor 33. Besides, the opening and closing operations of the valve switch 315 of the gas conveyor 31 can be controlled by the control module 32 to implement the gas transportation. Since the gas is transported to the airflow channel 22*g* through the continuous actuation of the gas conveyor 31, the gas is preserved due to the closing operation of the valve switch 315. Also, the inner pressure is monitored by the threshold setting mode of the pressure sensor 33, so as to adjust the appropriate inflation amount of the air bag layer 22*f* of the cup set 22. When the inflation amount reaches the setting threshold value, the miniature pump 311 of the gas conveyor 31 is immediately shutdown. If the inflation amount of the air bag layer 22*f* in the cup set 22 is insufficient, the user can control the threshold setting mode of the pressure sensor 33 through the control module 32, so as to appropriately adjust the setting threshold value of the inflation amount of the air bag layer 22*f*. In the mean time, the control module 32 controls the opening operation of the miniature pump 311 of the gas conveyor 31, so as to control the opening and closing operation time of the miniature pump 311. Consequently, the hardness, the appearance and the support strength of the first cup 22*a* and the second cup 22*b* can be arbitrarily adjustable to meet the demand of the user and achieve the effects of supporting stably, pushing up and intelligent saving power. In the embodiment, the touch sensor 1 is attached on the inner layer 22*e* of the cup set 22. Due to the inner pressure of the air bag layer 22*f* is adjusted by the gas-collecting actuating device 3, the first cup 22*a* and the second cup 22*b* are inflated to push the touch sensor 1 to fit the surface of the breasts, so that the touch sensor 1 can detect the variation of the surface of the breast. Consequently, the detection accuracy of the touch sensor 1 is enhanced.

In some embodiments, the gas conveyor 31 can be a miniature pump 311 as described above. In some other embodiments, the gas conveyor 31 can also be a blast miniature pump 30, respectively. Please refer to FIG. 7 and FIGS. 8A to 8C. The blast miniature pump 30 includes a nozzle plate 301, a chamber frame 302, an actuating body 303, an insulation frame 304 and a conducting frame 305 stacked on each other sequentially. The nozzle plate 301 includes a plurality of brackets 301*a*, a suspension plate 301*b* and a central aperture 301*c*. The suspension plate 301*b* is permitted to undergo a bending vibration. The pluralities of brackets 301*a* are connected to the periphery of the suspension plate 301*b*. In the embodiment, there are four brackets 301*a*, which are connected to four corners of the suspension plate 301*b*, respectively, but the present disclosure is not limited thereto. The central aperture 301*c* is formed at a central position of the suspension plate 301*b*. The chamber frame 302 is stacked on the suspension plate 301*b*. The actuating body 303 is stacked on the chamber frame 302. The actuating body 303 includes a piezoelectric carrying plate 303*a*, an adjusting resonance plate 303*b* and a piezoelectric plate 303*c*. The piezoelectric carrying plate 303*a* is stacked on the chamber frame 302. The adjusting resonance plate 303*b* is stacked on the piezoelectric carrying plate 303*a*. The piezoelectric plate 303*c* is stacked on the adjusting resonance plate 303*b*. The piezoelectric plate 303*c* is configured to drive the piezoelectric carrying plate 303*a* and the adjusting resonance plate 303*b* to bend and vibrate in the reciprocating manner in response to the applied voltage and the deformation thereof. The insulation frame 304 is stacked on the piezoelectric carrying plate 303*a* of the actuating body 303. The conducting frame 305 is stacked on the insulation frame 304. A resonance chamber 306 is formed among the actuating body 303, the chamber frame 302 and the suspension plate 301*b*.

Figure 8A:
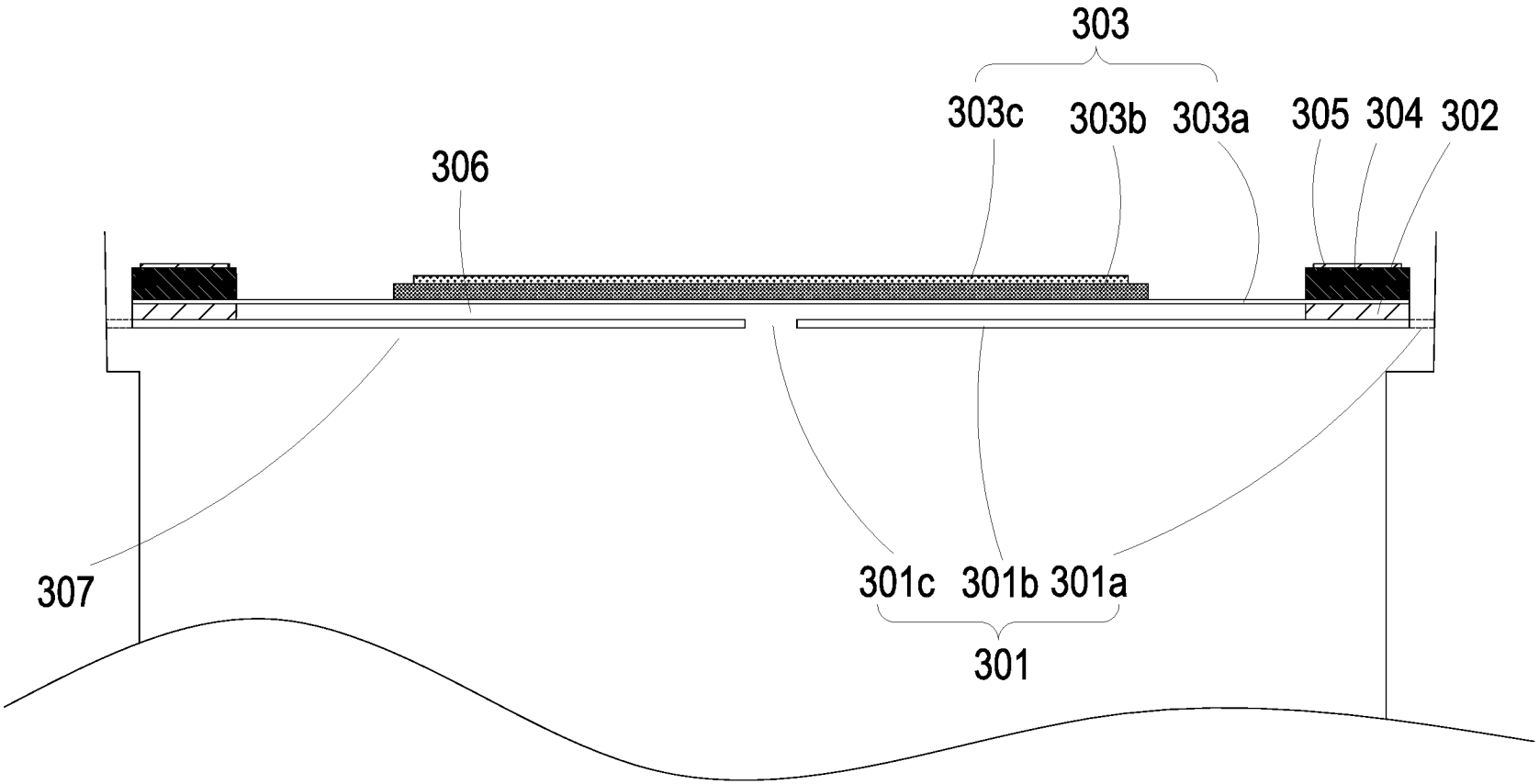
FIGS. 8A to 8C illustrate an operating process of the blast miniature pump of FIG. 7.
Figure 8B:
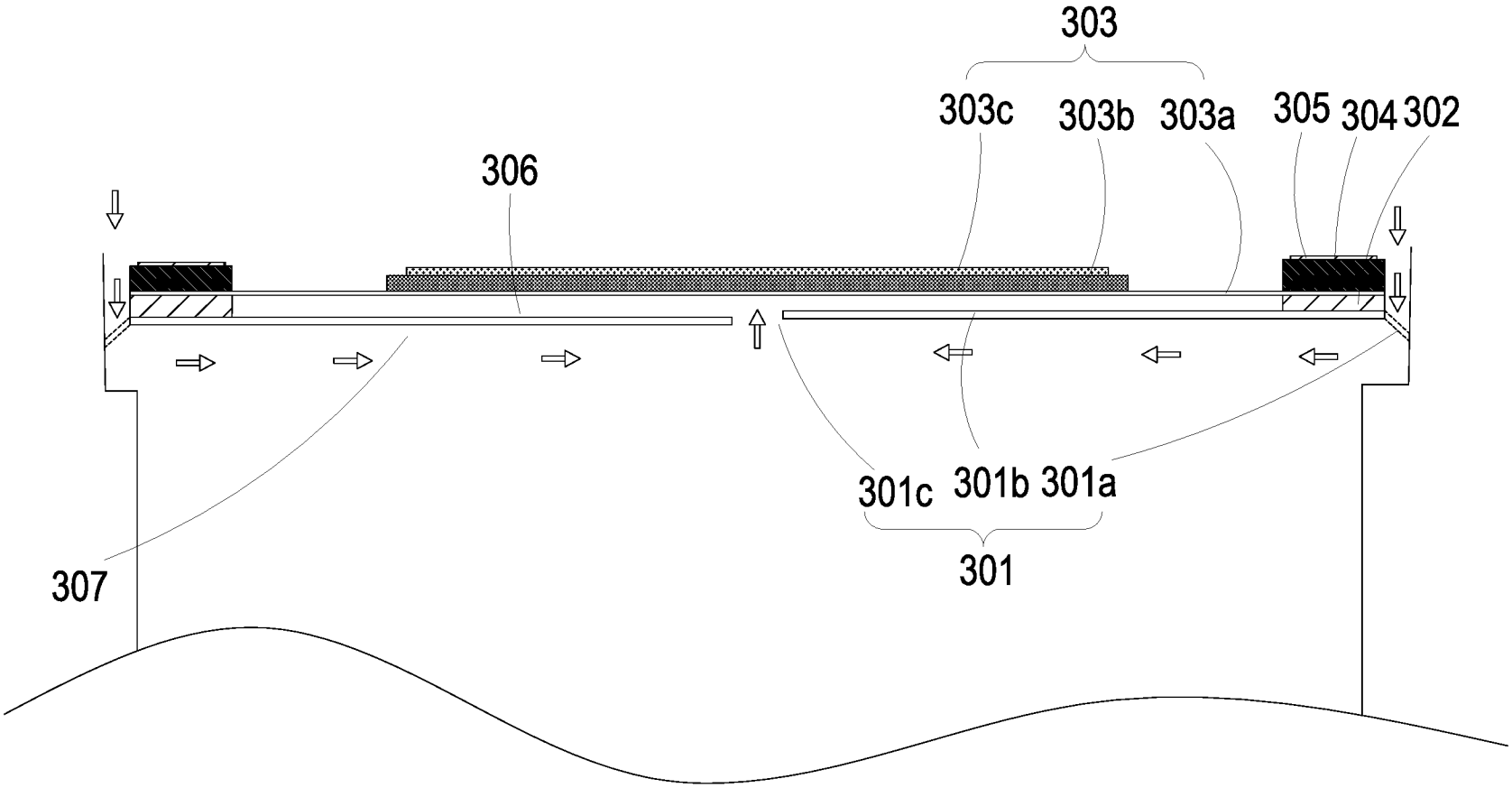
Figure 8C:
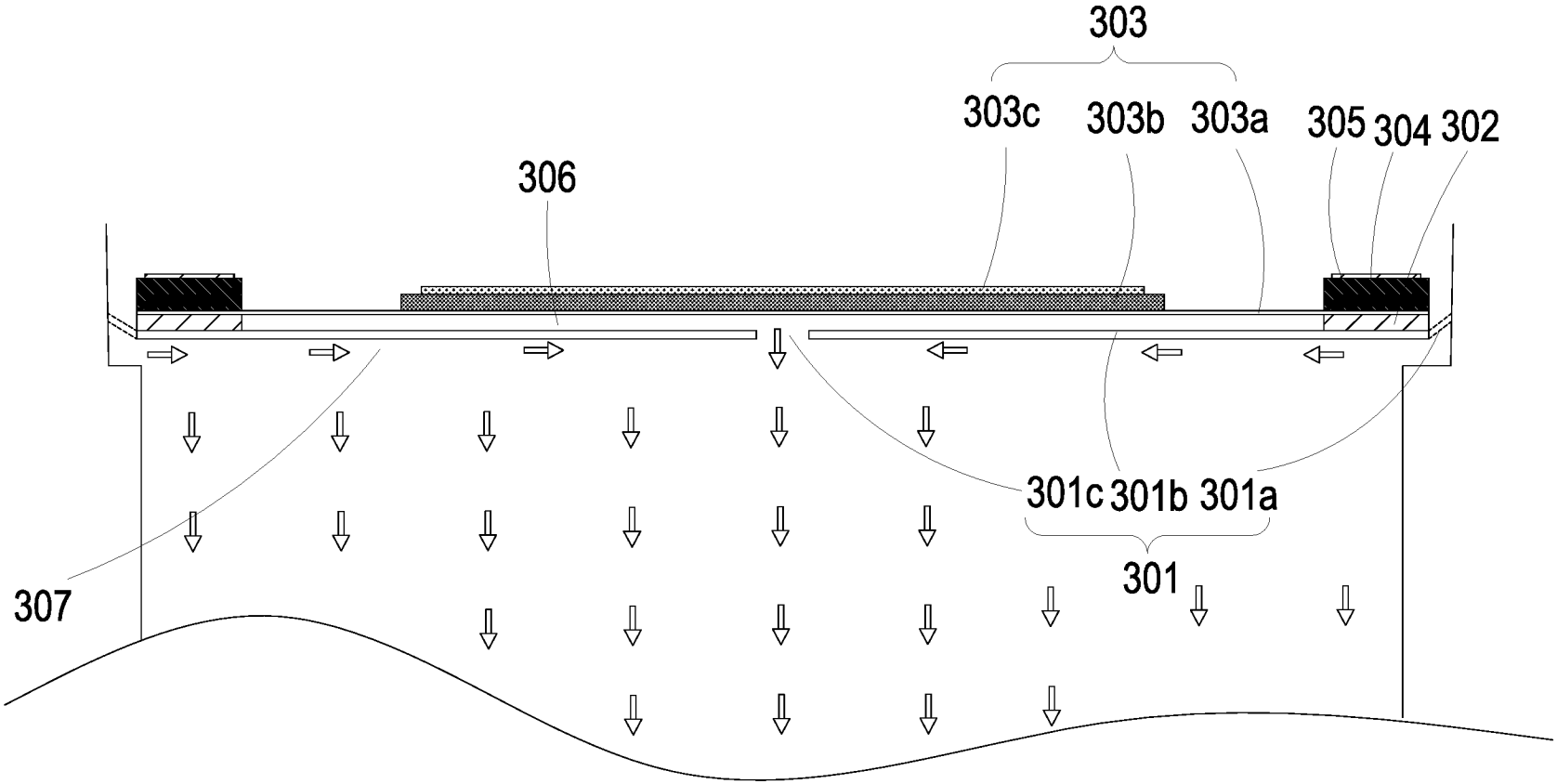

Please refer to FIGS. 8A to 8C. FIGS. 8A to 8C schematically illustrate the actions of the blast miniature pump of FIG. 7. Please refer to FIG. 7 and FIG. 8A firstly. The blast miniature pump 30 is fixedly disposed by the plurality of brackets 301*a*, and an airflow chamber 307 is formed under the bottom of the nozzle plate 301. Please refer to FIG. 8B again. When the piezoelectric plate 303*c* of the actuating body 303 is actuated by an applied voltage, the piezoelectric plate 303*c* of the actuating body 303 is deformed owing to the piezoelectric effect, and the adjusting resonance plate 303*b* and the piezoelectric carrying plate 303*a* are simultaneously driven to vibrate. Thereby, the nozzle plate 301 is driven to move due to the Helmholtz resonance effect, and the actuating body 303 is displaced upwardly. As so, the volume of the airflow chamber 307 is expanded, and a negative pressure is formed in the airflow chamber 307. The gas outside the blast miniature pump 30 is transported into the airflow chamber 307 through the vacant spaces formed among the suspension plate 301*b* and the brackets 301*a* of the nozzle plate 301 due to the pressure gradient, whereby the airflow chamber 307 is pressurized. Finally, please refer to FIG. 8C. The gas continuously flows into the airflow chamber 307 and a positive pressure is formed in the airflow chamber 307. At this time, the actuating body 303 is driven to displace downwardly, so that the volume of the airflow chamber 307 is shrunken and the gas inside the airflow chamber 307 is compressed and discharged out of the blast miniature pump 30. Consequently, the gas transportation is achieved by the blast miniature pump 30.

In some embodiments, the blast miniature pump 30 of the present disclosure may be a MEMS gas pump formed by a MEMS method. The nozzle plate 301, the chamber frame 302, the actuating body 303, the insulation frame 304 and the conducting frame 305 can all be made through a surface micromachining technology to reduce the volume of the blast miniature pump 30, so as to form a MEMS gas pump.

In summary, the present disclosure provides an intelligent bra including a gas-collecting actuating device collaborating with the air bag layer of the cup set, in which the gas conveyor of the gas-collecting actuating device is controlled to inflate or deflate the air bag layer of the cup set. By monitoring and adjusting the appropriate inflation amount of the air bag layer through the threshold setting mode of the pressure sensor of the gas-collecting actuating device, the inner pressure thereof is adjusted. In this way, the hardness, the appearance and the support strength of the first cup and the second cup can be arbitrarily adjustable according to the breasts shape of each user to achieve the effects of supporting stably and pushing up. Meanwhile, the touch sensor is attached on the inner layer of the cup set, due to the inflation of the air bag layer, the touch sensor is pushed to closely fit the surface of the breasts, so that the touch sensor can detect the variation of the surface of the breast. Consequently, the detection accuracy of the touch sensor is enhanced. Since the intelligent bra of the present disclosure is adjustable to fit the breasts of each user, the present disclosure has significant improvement in providing optimal wearing experience of a bra.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An intelligent bra comprising:

a main body comprising a supporting base, a cup set and two fixing elements, wherein the supporting base is configured to carry the cup set and connected to the two fixing elements, and the two fixing elements are respectively connected to two opposite sides of the supporting base so as to engage and connect with each other, and the cup set includes an outer layer, an inner layer and an air bag layer, the air bag layer is disposed between the outer layer and the inner layer to be covered by both the outer layer and the inner layer, and the air bag layer includes an airflow channel, wherein a connection end of the airflow channel protrudes out from the cup set; and a gas-collecting actuating device connecting to the connection end of the airflow channel and comprising a gas conveyor, a control module and a pressure sensor, wherein the gas conveyor transports gas to the air bag layer of the cup set to adjust an inner pressure of the air bag layer, and the control module controls an operation of the gas conveyor and a threshold setting mode of the pressure sensor, wherein the pressure sensor detects the inner pressure of the air bag layer, so as to monitor and notify the control module to control an operation of the gas conveyor.

2. The intelligent bra according to claim 1, wherein the intelligent bra further comprises a touch sensor attached on the inner layer of the cup set, wherein by adjusting the inner pressure of the air bag layer through the gas-collecting actuating device, the touch sensor is pushed by the air bag layer to closely configured to fit a surface of the breasts, so that the touch sensor configured to detect the variation of the surface of the breast, and a detection accuracy of the touch sensor is enhanced.

3. The intelligent bra according to claim 1, wherein the intelligent bra further comprises a touch sensor, and the air bag layer further comprises plural air bag protrusions disposed on the inner layer of the cup set, and the touch sensor is attached on the plural air bag protrusions, wherein by adjusting the inner pressure of the air bag layer through the gas-collecting actuating device, the touch sensor is pushed by the plural air bag protrusions to closely fit the surface of the breasts, so that the touch sensor configured to detect the variation of a surface of the breast, and a detection accuracy of the touch sensor is enhanced.

4. The intelligent bra according to claim 1, wherein the cup set further comprises a first cup and a second cup, the first cup and the second cup are disposed symmetrically with respect to a central part therebetween, wherein the airflow channel is disposed in the air bag layer, and the connection end extends along the central part and protrudes out from the outer layer of the cup set to couple with the gas-collecting actuating device.

5. The intelligent bra according to claim 1, wherein the gas conveyor further comprises a miniature pump, a gas-collecting seat, a chamber plate, a valve membrane and a valve switch, wherein the gas-collecting seat is disposed in the main body and comprises a gas-collecting slot concavely formed on a surface, which is in fluid communication with the connection end of the airflow channel, and is spatially corresponding to a first gas-collecting chamber and a first pressure-releasing chamber formed on another surface of the gas-collecting seat, wherein a gas-collecting perforation is formed and disposed between the gas-collecting slot and the first gas-collecting chamber to allow the gas-collecting slot and the first gas-collecting chamber to communicate with each other, wherein the first gas-collecting chamber and the first pressure-releasing chamber are separated apart on the another surface of the gas-collecting seat, and a communication channel is disposed between the first gas-collecting chamber and the first pressure-releasing chamber to allow the first gas-collecting chamber and the first pressure-releasing chamber to communicate with each other, wherein a first protrusion is formed in the first pressure-releasing chamber and a pressure-releasing perforation is disposed at a center of the first protrusion, wherein the pressure-releasing perforation is in fluid communication with the first pressure-releasing chamber and the valve switch, wherein the valve switch controls the pressure-releasing perforation to be opened or closed, and the valve switch is controlled by the control module, and the chamber plate is carried and disposed on the gas-collecting seat, wherein the chamber plate comprises a second gas-collecting chamber and a second pressure-releasing chamber formed on a top surface spatially corresponding to the gas-collecting seat, wherein the second gas-collecting chamber and the first gas-collecting chamber are matched and sealed with each other, and the second pressure-releasing chamber and the first pressure-releasing chamber are matched and sealed with each other, wherein a second protrusion is formed in the second gas-collecting chamber, and a communication chamber is concavely formed on a bottom surface of the chamber plate opposite to the second gas-collecting chamber and the second pressure-releasing chamber, wherein the miniature pump is carried and disposed on the chamber plate to seal and cover the communication chamber, and at least one communication aperture communicates with the communication chamber and is in fluid communication with the second gas-collecting chamber and the second pressure-releasing chamber, wherein the valve membrane is disposed between the gas-collecting seat and the chamber plate and abutted against the first protrusion to seal the pressure-releasing perforation, wherein the valve membrane has a valve aperture disposed at a position abutted against the second protrusion, and the valve aperture is abutted against by the second protrusion to be sealed.

6. The intelligent bra according to claim 5, wherein the miniature pump is controlled and driven to transport a gas by the control module, wherein the gas is inhaled and collected in the communication chamber, and then transported from the communication chamber to the second gas-collecting chamber and the second gas-releasing chamber through the communication aperture, whereby the valve membrane is pushed and moves apart from the second protrusion, the valve membrane is pushed to abut against the first protrusion and to seal the pressure-releasing perforation, and the gas in the second pressure-releasing chamber is transported into the second gas-collecting chamber through the communication channel and further transport into the first gas-collecting chamber through the valve aperture of the valve membrane, and whereby the gas is converged to the gas-collecting slot to inflate the air bag layer, so as to complete the air bag layer inflation.

7. The intelligent bra according to claim 5, wherein the miniature pump stops transporting gas operation, gas pressure of the air bag layer is greater than that of the communication chamber, whereby the gas converged in the air bag layer pushes the valve membrane to move and abut against the second protrusion, the valve aperture is sealed, the gas pushes the valve membrane to move and part from the first protrusion to open the pressure-releasing perforation, and the valve switch is controlled by the control module to be opened so as to discharge gas from the pressure-releasing perforation, wherein the gas converged in the air bag layer is transported to the pressure-releasing perforation and discharged out of the gas conveyor, so that a pressure-releasing operation of the air bag layer is performed.

8. The intelligent bra according to claim 5, wherein the miniature pump comprises:

a gas inlet plate having at least one inlet aperture, at least one convergence channel and a convergence chamber, wherein the at least one inlet aperture allows gas to flow in, and the convergence channel is disposed correspondingly to the inlet aperture and guides the gas from the inlet aperture toward the convergence chamber;

a resonance plate assembled with the gas inlet plate and having a central aperture, a movable part and a fixing part, wherein the central aperture is disposed at a center of the resonance plate and aligned with the convergence chamber of the gas inlet plate, the movable part surrounds the central aperture and spatially corresponds to the convergence chamber, and the fixing part is located at a peripheral portion of the resonance plate and is attached on the gas inlet plate; and a piezoelectric actuator facing and assembled with the resonance plate;

wherein a chamber space is formed between the resonance plate and the piezoelectric actuator, and when the piezoelectric actuator is driven, the gas is introduced into the at least one inlet aperture of the gas inlet plate, converged to the convergence chamber along the at least one convergence channel, and flows into the central aperture of the resonance plate, whereby the gas is further transported through a resonance between the piezoelectric actuator and the movable part of the resonance plate.

9. The intelligent bra according to claim 8, wherein the piezoelectric actuator comprises:

a suspension plate being a square suspension plate and permitted to undergo a bending vibration;

an outer frame arranged around the suspension plate;

at least one bracket connected between the suspension plate and the outer frame for elastically supporting the suspension plate; and a piezoelectric element, wherein a length of a side of the piezoelectric element is smaller than or equal to a length of a side of the suspension plate, and the piezoelectric element is attached on a surface of the suspension plate to drive the suspension plate to undergo the bending vibration in response to an applied voltage.

10. The intelligent bra according to claim 8, wherein the miniature pump further comprises a first insulation plate, a conducting plate and a second insulation plate, wherein the gas inlet plate, the resonance plate, the piezoelectric actuator, the first insulation plate, the conducting plate and the second insulation plate are stacked sequentially.

11. The intelligent bra according to claim 9, wherein the suspension plate comprises a bulge disposed on a second surface opposite to a first surface attached to the piezoelectric element.

12. The intelligent bra according to claim 11, wherein the bulge is formed by an etching process, and a convex structure is formed on the second surface opposite to the first surface of the suspension plate attached to the piezoelectric element.

13. The intelligent bra according to claim 8, wherein the piezoelectric actuator comprises:

a suspension plate being a square suspension plate and permitted to undergo a bending vibration;

an outer frame arranged around the suspension plate;

at least one bracket connected between the suspension plate and the outer frame for elastically supporting the suspension plate, wherein a surface of the suspension plates and a surface of the outer frame form a non-coplanar structure, and a cavity space is maintained between the surface of the suspension plate and the resonance plate; and a piezoelectric element, wherein a length of a side of the piezoelectric element is smaller than or equal to a length of a side of the suspension plate, and the piezoelectric element is attached on the surface of the suspension plate to drive the suspension plate to undergo the bending vibration in response to an applied voltage.

14. The intelligent bra according to claim 5, wherein the miniature pump is microelectromechanical-system micro pump.

15. The intelligent bra according to claim 5, wherein the miniature pump is a blast miniature pump, and comprises:

a nozzle plate having a plurality of brackets, a suspension plate and a central aperture, wherein the suspension plate is permitted to undergo a bending vibration, the plurality of brackets are connected to the periphery of the suspension plate for providing an elastic support, the central aperture is formed at a central position of the suspension plate, and the blast miniature pump is fixedly disposed by the plurality of brackets, and an airflow chamber is formed under the bottom of the nozzle plate, and at least one vacant space is formed among the suspension plate and the brackets;

a chamber frame stacked on the suspension plate;

an actuating body stacked on the chamber frame, wherein when a voltage is applied, the suspension plate is driven to undergo the bending vibration;

an insulation frame stacked on the actuating body; and a conducting frame stacked on the insulation frame;

wherein, a resonance chamber is formed among the actuating body, the chamber frame and the suspension plate, when the actuating body is actuated by an applied voltage, the actuating body is deformed, and the nozzle plate is simultaneously driven to vibrate, whereby the suspension plate is driven to undergo the displaced vibration, so that the gas is transported into the airflow chamber through the at least one vacant space and discharged to achieve the gas transportation.

16. The intelligent bra according to claim 15, wherein the actuating body further comprises:

a piezoelectric carrying plate stacked on the chamber frame;

an adjusting resonance plate stacked on the piezoelectric carrying plate; and a piezoelectric plate stacked on the adjusting resonance plate for receiving the applied voltage, so as to drive the piezoelectric carrying plate and the adjusting resonance plate to bend and vibrate in the reciprocating manner in response to the applied voltage.

17. The intelligent bra according to claim 5, wherein the gas is transported to the airflow channel through the continuous actuation of the miniature pump of the gas conveyor, and guided to the air bag layer to be inflated, wherein the inflation amount of the air bag layer is monitored by the threshold setting mode of the pressure sensor, and the control module controls the open/close state of the valve switch for the purpose of preserving the gas inside the air bag layer, wherein the appropriate inflation amount of the air bag layer is adjusted and monitored by the threshold setting mode of the pressure sensor, and when the inflation amount reaches the setting threshold value, the miniature pump is immediately shutdown.

18. The intelligent bra according to claim 17, wherein if the inflation amount of the air bag layer is insufficient, the user controls the threshold setting mode of the pressure sensor through the control module to appropriately adjust the setting threshold value of the inflation amount of the air bag layer, whereby the miniature pump is actuated and the operation time of the miniature pump is under control of the control module.

* * * * *